US007214179B2

(12) United States Patent
Miller, III et al.

(10) Patent No.: US 7,214,179 B2
(45) Date of Patent: May 8, 2007

(54) LOW ACCELERATION SENSITIVITY MICROPHONE

(75) Inventors: Scott Allan Miller, III, Lafayette, CO (US); Robert Edwin Schneider, Erie, CO (US); David L. Basinger, Loveland, CO (US); Travis Rian Andrews, Loveland, CO (US); Bernd Waldmann, Boulder, CO (US)

(73) Assignee: Otologics, LLC, Boulder, CO (US)

( * ) Notice: Subject to any disclaimer, the term of this patent is extended or adjusted under 35 U.S.C. 154(b) by 221 days.

(21) Appl. No.: 11/097,113

(22) Filed: Apr. 1, 2005

(65) Prior Publication Data

US 2005/0222487 A1 Oct. 6, 2005

Related U.S. Application Data

(63) Continuation-in-part of application No. 10/982,639, filed on Nov. 5, 2004.

(60) Provisional application No. 60/643,074, filed on Jan. 11, 2005, provisional application No. 60/558,693, filed on Apr. 1, 2004.

(51) Int. Cl.
*H04R 25/00* (2006.01)

(52) U.S. Cl. ..... 600/25; 381/71.2; 181/175

(58) Field of Classification Search ..... 600/25; 607/55–57; 181/129–137, 148, 151, 157–158, 181/175; 381/312–331, 71.1–71.14
See application file for complete search history.

(56) References Cited

U.S. PATENT DOCUMENTS

| | | | | |
|---|---|---|---|---|
| 4,443,666 | A | 4/1984 | Cote | 318/113 |
| 4,450,930 | A | 5/1984 | Killion | 181/129 |
| 4,504,703 | A | 3/1985 | Schneiter et al. | 181/163 |
| 4,532,930 | A | 8/1985 | Crosby et al. | 128/419 |
| 4,606,329 | A | 8/1986 | Hough | 128/1 |
| 4,607,383 | A | 8/1986 | Ingalls | 381/113 |
| 4,621,171 | A | 11/1986 | Wada et al. | 381/113 |
| 4,774,933 | A | 10/1988 | Hough et al. | 600/25 |
| 4,815,560 | A | 3/1989 | Madaffari | 181/129 |
| 4,837,833 | A | 6/1989 | Madaffari | 181/129 |
| RE33,170 | E | 2/1990 | Byers | 128/419 |
| 4,932,405 | A | 6/1990 | Peeters et al. | 128/419 |
| 4,936,305 | A | 6/1990 | Ashtiani et al. | 128/420.6 |
| 5,001,763 | A * | 3/1991 | Moseley | 381/71.6 |
| 5,015,224 | A | 5/1991 | Maniglia | 600/25 |
| 5,105,811 | A | 4/1992 | Kuzma | 128/420.6 |
| 5,163,957 | A | 11/1992 | Sade et al. | 623/10 |
| 5,176,620 | A | 1/1993 | Gilman | 600/25 |
| 5,277,694 | A | 1/1994 | Leysieffer et al. | 600/25 |

(Continued)

*Primary Examiner*—John P. Lacyk
(74) *Attorney, Agent, or Firm*—Marsh Fischmann & Breyfogle, LLP

(57) ABSTRACT

An implanted microphone is provided that has reduced sensitivity to vibration and attendant acceleration forces. In this regard, the microphone differentiates between the desirable and undesirable components of a transcutaneously received signal. More specifically, the present invention utilizes an output that is indicative of acceleration forces acting on the implanted microphone (e.g., an acceleration signal) to counteract and/or cancel the effects of acceleration induced pressures in an output signal of a microphone diaphragm. This may be done in a variety of ways, including but not limited to, pneumatically, mechanically, electrical analog, or digitally, or combinations thereof. In one arrangement, the generated output may be filtered to match the an acceleration response of the output signal of the microphone diaphragm such that upon removal of the motion signal from the microphone output, the remaining signal is an acoustic signal.

65 Claims, 12 Drawing Sheets

U.S. PATENT DOCUMENTS 5,363,452 A 11/1994 Anderson ..... 381/170
5,402,496 A 3/1995 Soli ..... 381/94.2
5,411,467 A 5/1995 Hortmann et al. ..... 600/25
5,456,654 A 10/1995 Ball ..... 600/25
5,475,759 A 12/1995 Engelbreston ..... 381/318
5,500,902 A 3/1996 Stockham, Jr. et al. ..... 381/320
5,554,096 A 9/1996 Ball ..... 600/25
5,558,618 A 9/1996 Maniglia ..... 600/25
5,624,376 A 4/1997 Ball et al. ..... 600/25
5,680,467 A 10/1997 Hansen ..... 381/314
5,702,431 A 12/1997 Wang et al. ..... 607/61
5,749,912 A 5/1998 Zhang et al. ..... 607/57
5,762,583 A 6/1998 Adams et al. ..... 600/25
5,795,287 A 8/1998 Ball et al. ..... 600/25
5,800,336 A 9/1998 Ball et al. ..... 600/25
5,814,095 A 9/1998 Muller et al. ..... 607/57
5,842,967 A 12/1998 Kroll ..... 600/25
5,848,171 A 12/1998 Stockham, Jr. et al. ..... 381/310
5,857,958 A 1/1999 Ball et al. ..... 600/25
5,859,916 A 1/1999 Ball et al. ..... 381/326
5,881,158 A 3/1999 Lesinski et al. ..... 381/174
5,888,187 A 3/1999 Jaeger et al. ..... 600/25
5,897,486 A 4/1999 Ball et al. ..... 600/25
5,906,635 A 5/1999 Maniglia ..... 607/57
5,912,977 A 6/1999 Gottschalk-Schoenig ... 381/321
5,913,815 A 6/1999 Ball et al. ..... 600/25
5,951,601 A 9/1999 Lesinski et al. ..... 623/10
6,031,922 A * 2/2000 Tibbetts ..... 381/313
6,044,162 A 3/2000 Mead et al. ..... 381/312
6,072,884 A 6/2000 Kates ..... 381/318
6,072,885 A 6/2000 Stockham, Jr. et al. ..... 381/321
6,097,823 A 8/2000 Kuo ..... 381/312
6,104,822 A 8/2000 Melanson et al. ..... 381/320
6,108,431 A 8/2000 Bachler ..... 381/312
6,128,392 A 10/2000 Leysieffer et al. ..... 381/318
6,134,329 A 10/2000 Gao et al. ..... 381/60
6,151,400 A 11/2000 Seligman ..... 381/317
6,163,287 A 12/2000 Huang ..... 341/143
6,173,063 B1 1/2001 Melanson ..... 381/318
6,198,971 B1 3/2001 Leysieffer ..... 607/55
6,381,336 B1 4/2002 Lesinski et al. ..... 381/326
6,422,991 B1 7/2002 Jaeger ..... 600/25
6,626,822 B1 9/2003 Jaeger ..... 600/25
6,707,920 B2 3/2004 Miller ..... 381/326
6,807,445 B2 10/2004 Baumann ..... 607/57

* cited by examiner

LOW ACCELERATION SENSITIVITY MICROPHONE

CROSS REFERENCE TO RELATED APPLICATIONS

This application claims priority under 35 U.S.C. 119 to: U.S. Provisional Application No. 60/558,693 entitled: "Low Acceleration Sensitivity Microphone," having a filling date of Apr. 1, 2004; and U.S. Provisional Application No. 60/643,074 entitled: "Active Vibration Attenuation for Implantable Microphone," having a filing date of Jan. 11, 2005; and claims priority under 35 U.S.C. 120 as a continuation-in-part to U.S. patent application Ser. No. 10/982,639 entitled "Active Vibration Attenuation for Implantable Microphone," having a filing date of Nov. 5, 2004; the contents of each of which are incorporated herein as if set forth in full.

FIELD OF THE INVENTION

The present invention relates to implanted microphone assemblies, e.g. as employed in hearing aid instruments, and more particularly, to implanted microphone assemblies having reduced sensitivity to acceleration.

BACKGROUND OF THE INVENTION

Until recently, a large number of people affected by sensorineural hearing loss of 55 dB or more have been unable to receive adequate therapeutic benefit from any available technology. This problem has been alleviated to some extent by the development of a class of hearing aids generally referred to as implantable hearing instruments, which include, for example, middle ear implants and cochlear implants. Generally, such implantable hearing instruments utilize an implanted transducer to stimulate a component of the patient's auditory system (e.g., tympanic membrane, ossicles and/or cochlea). By way of example, one type of implantable transducer includes an electromechanical transducer having a magnetic coil that drives a vibratory actuator. The actuator is positioned to interface with and stimulate the ossicular chain of the patient via physical engagement. (See e.g. U.S. Pat. No. 5,702,342). In this regard, one or more bones of the ossicular chain are made to mechanically vibrate causing stimulation of the cochlea through its natural input, the so-called oval window.

Amongst users of implantable hearing instruments, there is a strong desire for a small, fully implantable system. In such hearing instruments, the entirety of the instrument's of various hearing augmentation components, including a microphone assembly, is positioned subcutaneously on or within a patient's skull, typically at locations proximate the mastoid process.

As may be appreciated, implantable hearing instruments that utilize an implanted microphone require that the microphone be positioned at a location that facilitates the receipt of acoustic signals. For such purposes, such implantable microphones may be typically positioned in a surgical procedure between a patient's skull and skin, at a location rearward and upward of a patient's ear (e.g., in the mastoid region). Accordingly, the hearing instrument must overcome the difficulty of detecting external sounds (i.e., acoustic sounds) after attenuation by a layer of skin. In this regard, a subcutaneously located microphone must provide adequate acoustic sensitivity while being covered by a layer of skin between about 3 mm and 12 mm thick.

Further, a subcutaneously located microphone must also be able to discriminate between acoustic sounds and unwanted vibrations. That is, acceleration within patient tissue (e.g., caused by tissue-borne vibration) may cause pressure fluctuations that are commingled with pressure fluctuations caused by acoustic sounds impinging on tissue overlying an implanted microphone. This undesirable commingling of ambient acoustic signals and tissue-borne acceleration signals is at the root of several problems facing the designers of implantable hearing systems.

One particular problem relates to vibrations caused by the implant wearer's voice, chewing or vibration caused by the hearing instrument itself (e.g., an electromechanical transducer) may generate distortion of wearer's own voice, feedback and/or reduce acoustic sensitivity. For example, sound emanating from the vocal chords of a person wearing an implantable hearing instrument passes through the bony structure of the head (i.e., as a vibration) and reaches the implanted microphone of the implantable middle ear hearing system or fully implantable cochlear implant. The vibration reaches the microphone and may induce pressure fluctuations within the skin due to acceleration. Accordingly, such pressure fluctuations may be amplified just as a pressure fluctuation caused by the deflection of the skin's surface by an acoustic sound. In this regard, the implanted microphone detects the combination of these two sources as a single varying pressure. Further, in systems employing a middle ear stimulation transducer, the microphone may produce feedback by picking up and amplifying vibration caused by the stimulation transducer. As such, the bone-borne vibration undesirably limits the maximum achievable gain of the implantable hearing instrument.

In order to achieve a nearly natural quality of the implant wearer's voice and detect acoustic signals with sufficient sensitivity, an implanted microphone needs to compensate for acceleration pressures and/or feedback. The aim of the present invention is to design an implantable microphone that achieves these goals.

SUMMARY OF THE INVENTION

Although all microphones possess some degree of acceleration sensitivity, unwanted responses from acceleration is not a significantly limiting to the performance of acoustic microphones, that is, microphones designed to operate in air. The inventors of the present invention have recognized that the same is not true, however, for subdermal/implanted microphones as acceleration within tissue arising from tissue-borne vibration (e.g., from talking or chewing) causes pressure fluctuations that are combined/commingled by the implanted microphone with pressure fluctuations caused by external/ambient sounds. In this regard, pressure fluctuations in tissue (e.g., overlying an implanted microphone) may arise from external pressures such as ambient acoustic signals (i.e., sound) impinging on the skin as well as from acceleration within the tissue caused by vibration. Accordingly, a method and system for distinguishing or isolating an acoustic signal component from a commingled signal is desirable.

In appreciating the nature of this problem, it is important to distinguish between two mechanisms that cause a microphone to be sensitive to vibration: acceleration sensitivity of the microphone's internal microphone element (e.g., the element that translates pneumatic pressures into an electrical output) and acceleration pressure sensitivity, which acts on the entire microphone including the microphone diaphragm. Typically, a microphone element may be selected with sufficiently low acceleration sensitivity (e.g., 60 dB SPL/g) such that the inherent vibration sensitivity of the microphone is dominated by the acceleration pressure sensitivity. In this regard, acceleration pressure is a limiting factor in implantable microphone design. In any case, some degree of vibration sensitivity and attendant acceleration sensitivity is inherent in any microphone, despite design measures to minimize it.

It is possible to reduce vibration sensitivity of a microphone assembly through vibration isolation. In its simplest form, a vibration isolator is a spring (i.e., compliant member) that suspends the assembly to be isolated. The spring rate of the isolator is chosen so that the resonate frequency of the suspended microphone is much lower than the lowest frequency to be isolated, typically by a factor of five or more. While reducing the effects of vibration directly on the microphone, it will be appreciated that vibration may still cause acceleration induced pressure variations within the tissue overlying the microphone and microphone diaphragm. Therefore, such acceleration must still be accounted for to better isolate ambient acoustic signals from a commingled signal. In this regard, the inventors have further recognized the desirability of actively accounting for the effects of acceleration and have produced a microphone that exhibits low sensitivity to acceleration-induced pressures.

More specifically, the present invention utilizes an output that is indicative of acceleration acting on the microphone (e.g., an acceleration signal) to counteract and/or cancel the effects of acceleration-induced pressures in an output signal of a microphone diaphragm. Generally, the acceleration signal and the acceleration induced pressures effects in the output signal will correspond to a common source (e.g., a common vibration). Accordingly, the magnitude an/or phase of the acceleration signal acceleration induced pressure effects may be mathematically related. Counteracting and/or canceling the effect of acceleration may be done in a variety of ways, including but not limited to, pneumatically, mechanically, electrical analog, or digitally, or combinations thereof. In order to better account for the effect of acceleration on the microphone, the acceleration signal, microphone diaphragm output signal, or both may be filtered and adjusted for gain (again, including but not limited to pneumatically, mechanically, electrical analog or digitally or any combination thereof) before utilizing the acceleration signal for counteraction/cancellation. This filtering may have the effect of more closely matching the acceleration signal to the acceleration responses in the microphone output signal and thereby substantially reduce the effects of acceleration on the implanted microphone. The filter or filters may be adjustable and/or adaptive in order to allow optimal rejection of vibration for a given patient under a variety of changing conditions.

According to one aspect of the invention, a method for isolating an acoustic signal from a commingled signal in an implantable microphone is provided. The method includes providing a first output that corresponds to a transcutaneously received pressure signal, where the first output has an acoustic component and an acceleration component. A second output is supplied that corresponds to an acceleration force acting on the implantable microphone. At least a portion of the first and second outputs are used to generate a combined output, wherein an acceleration component of the combined output is less than the acceleration component of the first output.

The first output may correspond to an output of a first microphone diaphragm that is positioned to receive pressure variations through overlying tissue. As noted above, such pressure variations may include commingled acoustic and acceleration pressures. Generally, the second output is substantially isolated from acoustic forces acting on the implanted microphone assembly. Stated otherwise, the second output of the cancellation surface may be a response having an acceleration component that is significantly larger than an acoustic component or that is substantially free of an acoustic component.

The outputs may be combined in any appropriate manner including pneumatically and electrically. Generally, the acceleration component of the second output is removed from the acceleration component of the first output to at least partially isolate the acoustic component. This isolated acoustic component may then be utilized to actuate an actuator of a hearing instrument. This may entail additional processing of the isolated acoustic component.

How the first and second outputs are used to generate a combined output may correspond to how the first and second outputs are obtained. For instance, if the first and second outputs are obtained by deflecting first and second diaphragms in response to applied forces, the volumetric deflection of these outputs may be pneumatically combined. Alternatively, each volumetric deflection may be converted into an electrical signal and electrically combined. As a further alternative, the second output may originally include an electrical output. For instance, where the second output is generated by an accelerometer the output of such an accelerometer may be an electric signal indicative of, for example, the phase and/or magnitude of the movement of the accelerometer. Furthermore, each output may also be filtered to better match the second output to the acceleration component of the first output.

According to another aspect of the invention, a method for use in an implantable microphone is provided. The method includes locating a first diaphragm to receive ambient acoustic signals (e.g., through overlying tissue) and positioning a cancellation surface to be isolated from such ambient acoustic signals, wherein at least a portion of the cancellation surface is operable to respond to acceleration forces. A first output is provided by the first diaphragm in response to an applied acceleration. This output includes a first acceleration component and an acoustic component. A second output is supplied by the cancellation surface in response to the applied acceleration. The second output includes a second acceleration component.

Portions of the first and second outputs may be used to generate a third output. Preferably, a third acceleration component of the third output will be less than the first acceleration component of the first output for at least a desired frequency range. In this regard, at least a portion of the first acceleration component is removed form the acoustic component of the first diaphragm. The using step may include subtracting said second output from said first output.

Generally, the first diaphragm is located on the surface of a microphone housing such that it may receive incident ambient acoustic signal through overlying tissue. The cancellation surface may be positioned within an interior of such a housing to isolate the cancellation surface from incident ambient acoustic signals. The cancellation surface may be rigidly connected to such a housing to allow the cancellation surface to respond to acceleration forces acting on the microphone housing. Alternatively, the cancellation surface may be co-located with and/or affixed to the first diaphragm such that these elements experience similar acceleration.

According to another aspect of the present invention, an implantable microphone is provided that includes a housing having an internal chamber with an aperture thereto and a first diaphragm sealably positioned across the aperture. The first diaphragm is operative to move in response to acoustic forces and acceleration forces present in media (e.g. tissue) overlying the first diaphragm. That is, the first diaphragm receives a combined pressure signal that includes an acoustic pressure component and an acceleration pressure component corresponding to tissue-borne vibrations. The microphone also includes a reference or cancellation surface at least a portion of which moves relative to the housing in response to the acceleration forces acting on the housing. A sensor is utilized to generate an output that is indicative of relative movement between the first diaphragm and the cancellation surface.

Typically, the relative movement between the first diaphragm and the cancellation surface is dominated by the pressure component(s) associated with acoustic forces received by the first diaphragm and which may be isolated from the cancellation surface. In this regard, the first diaphragm moves in relation to the acoustic forces while the cancellation surface remains substantially stationary (i.e., in relation to the acoustic forces). Both the first diaphragm and the cancellation surface move in relation to the acceleration forces. Accordingly, an output signal indicative of a change in the relative positions of the microphone diaphragm and the cancellation surface generally corresponds to the acoustic forces (e.g., an ambient acoustic signal).

That is, the output signal of the sensor may correspond to the acoustic forces acting on the microphone diaphragm. Accordingly, this output signal may be further processed and/or utilized for stimulating a component of the patient's auditory system (e.g., tympanic membrane, ossicies and/or cochlea). Stated otherwise, the microphone utilizes a diaphragm and a cancellation surface to distinguish between pressure fluctuations in tissue overlying the microphone caused by ambient acoustic sounds and acceleration in patient tissue.

While the output signal may be indicative of a relative movement of the first diaphragm relative to the cancellation surface, this relative movement may be monitored/measured in a number of different ways. For instance, physical changes between the microphone diaphragm and the cancellation surface may be measured. For example, a pressure of an enclosed space defined between the first diaphragm and the cancellation surface may be monitored to identify such relative movement. Alternatively, a distance between pre-selected regions on each of the first diaphragm and cancellation surface may be monitored to identify changes in relative position.

In other arrangements, relative movement may be monitored electrically. For instance, a change in voltage between pre-selected regions on the first diaphragm and the cancellation surface may be monitored. In this regard, a first electrode may be interconnected to the first diaphragm and a second electrode may be interconnected to the cancellation surface in order to measure a voltage across an electrically active element disposed therebetween (e.g., a compressible electret or a piezo-electric member). Alternatively, the first diaphragm and/or the cancellation surface may be made of a conductive material such that those elements themselves form electrodes and/or capacitor plates. In this regard, changes in a capacitance may be monitored. In further arrangements, coils and or magnets may be interconnected to the diaphragm and/or cancellation surface such that voltages and or inductances may be generated in corresponding relation to the relative change.

Alternatively, force may be utilized to identify relative movement between the first diaphragm and cancellation surface. In this regard, force-measuring devices (e.g., piezoelectric members) may be physically disposed between surfaces of the first diaphragm cancellation surface. Alternatively, strain gages may be utilized to monitor changes within each of the first diaphragm and the cancellation surface.

In all cases, it may be desirable that the magnitude of the response of the cancellation surface to acceleration be chosen to substantially match the response of the first diaphragm to acceleration, and the phases should be substantially matched as well in order to achieve enhanced cancellation. It may be preferred that such magnitude and phase matching occur in a frequency range of interest (e.g., and acoustic hearing range). This may require that the resonant frequency of each the first diaphragm and cancellation surface be less than about 2000 Hz and more preferably less than about 200 Hz. These resonant frequencies are typically below an acoustic hearing frequency range. Further, it may be desirable that the first diaphragm and cancellation surface have substantially equal resonant frequencies and/or equal damping factors.

In another arrangement, the resonant frequency of the first diaphragm and/or cancellation surface may be greater than most or all of an acoustic hearing frequency range. In such an arrangement, the response of the first diaphragm and/or cancellation surface may be flatter over a greater frequency range. This may permit more easily matching outputs from these elements.

The cancellation surface may be any surface that is operative to move in response to acceleration forces applied to the microphone. In this regard, the cancellation surface may be considered an accelerometer or more generally a motion sensor. The physical configuration of this accelerometer/motion sensor (hereafter accelerometer) and the output of the accelerometer may vary. For instance, the accelerometer may include a compliantly supported mass (e.g., a proof or seismic mass). Inertial movement of the proof mass in response to acceleration forces may physically counteract the movement of the microphone diaphragm in response to acceleration.

In another arrangement, the cancellation surface may generate an electrical output (acceleration signal), which may subsequently be combined (e.g., subtracted) with an electrical microphone output signal of the first diaphragm. Use of such electrical signals may facilitate filtering of the acceleration signal of the accelerometer and/or the microphone output signal to better match, for example, the phase and/or magnitude of these signals.

In further arrangement, the output of the cancellation surface may pneumatically counteract the acceleration response of the first diaphragm. In such an arrangement, portions of the cancellation surface and first diaphragm may each move relative to an enclosed space. Accordingly, if the first diaphragm and cancellation surface displace substantially equal and opposite volumes relative to the enclosed space (i.e., in response to acceleration), the change in the volume of the enclosed space will primarily represent the acoustic forces on the first diaphragm. In one particular arrangement, the cancellation surface is a mass loaded second diaphragm (e.g., cancellation diaphragm), which may be disposed within the housing of the microphone such that it is substantially isolated from acoustic forces. To permit the second diaphragm to respond similarly to the first diaphragm, the mass loading of the second diaphragm may approximate the mass loading of the first diaphragm by overlying media.

In another arrangement, where the cancellation surface is a mass loaded second diaphragm, the first and second diaphragms may move relative to first and second enclosures, respectively. Accordingly, first and second microphone elements may generate first and second electrical output signals, which may subsequently be combined to produce a microphone output signal having a reduced acceleration response.

According to another aspect of the present invention, an implantable microphone is provided that allows for pneumatically extracting an acoustic signal from a transcutaneously received pressure signal. More particularly, the microphone includes housing having an internal chamber and an aperture thereto and a first diaphragm sealably positioned across the aperture. The microphone further includes a second diaphragm at least partially disposed within the housing and in a spaced relationship with the first diaphragm, wherein the first and second diaphragms define a trapped volume. A proof mass is attached to the second diaphragm to deflect the second diaphragm in response to acceleration. A sensor is operative to sense pressure changes within the trapped volume and generate an output signal indicative thereof.

The first diaphragm is operative to transcutaneously receive a combined pressure signal that includes an acoustic pressure component corresponding with an acoustic signal (i.e., from acoustic pressure impinging on the external) and an acceleration component corresponding with acceleration in tissue overlying the first diaphragm. The second diaphragm is operative to respond to an acceleration signal while being substantially isolated from the acoustic signal. The movement of the first and second diaphragm relative to the trapped volume constitutes a summation process, which cancels the acceleration component of the first diaphragm using the acceleration response of the second diaphragm. Accordingly, the output of the sensor corresponds to the acoustic signal.

To match the responses of the first and second diaphragms, these diaphragms may have similar shapes and may be rigidly connected about their peripheries. To maintain substantially equal shapes upon deflection, one or both diaphragms may include a reinforcing member.

According to another aspect of the invention, an implantable microphone is provided that generates a first and second outputs for subsequent summation. The microphone includes a first diaphragm operative to receive pressure variations in overlying media and generate a corresponding first output signal. This first output signal may include an acceleration component and an acoustic component. A cancellation surface is operative to generate a second output signal indicative of acceleration. A summation device combines the first and second output signals to generate a combined output signal that is operative to actuate an actuator of a hearing instrument.

The summation device may remove at least a portion of the second output from the first output such that an acceleration component of the combined output signal is less than the acceleration component of the first output signal. This may entail subtracting the second signal form the first signal.

In one arrangement, the first and second outputs are electrical outputs and the summation device is an electric summation device. This arrangement may further include a first filter for filtering the first output and/or a second filter for filtering the second output.

DETAILED DESCRIPTION OF THE INVENTION

Reference will now be made to the accompanying drawings, which at least assist in illustrating the various pertinent features of the present invention. In this regard, the following description of a hearing instrument is presented for purposes of illustration and description. Furthermore, the description is not intended to limit the invention to the form disclosed herein. Consequently, variations and modifications commensurate with the following teachings, and skill and knowledge of the relevant art, are within the scope of the present invention. The embodiments described herein are further intended to explain the best modes known of practicing the invention and to enable others skilled in the art to utilize the invention in such, or other embodiments and with various modifications required by the particular application (s) or use(s) of the present invention.

Figure 1:
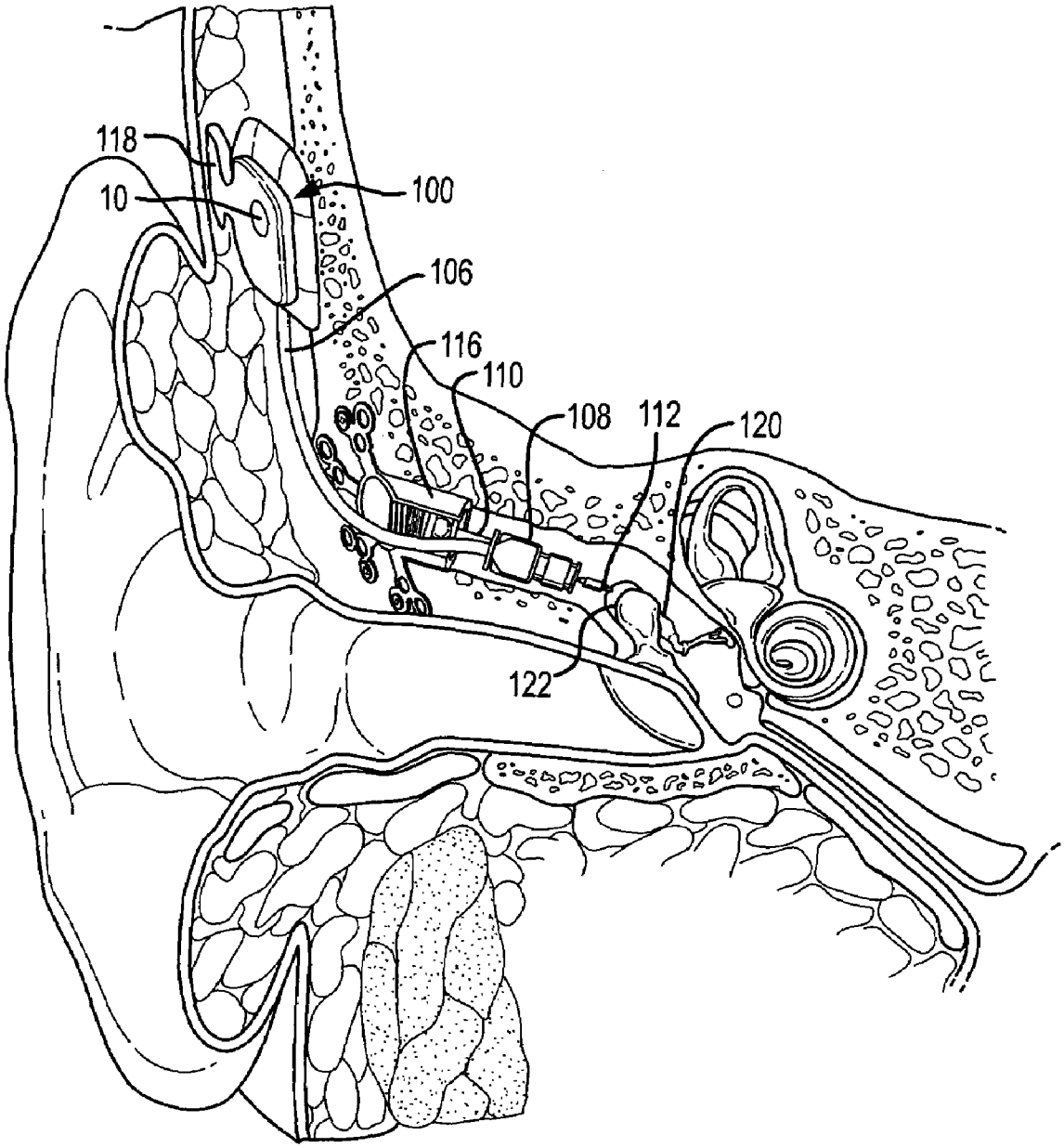
FIG. 1 illustrates a fully implantable hearing instrument as implanted in a wearer's skull.
Figure 2:
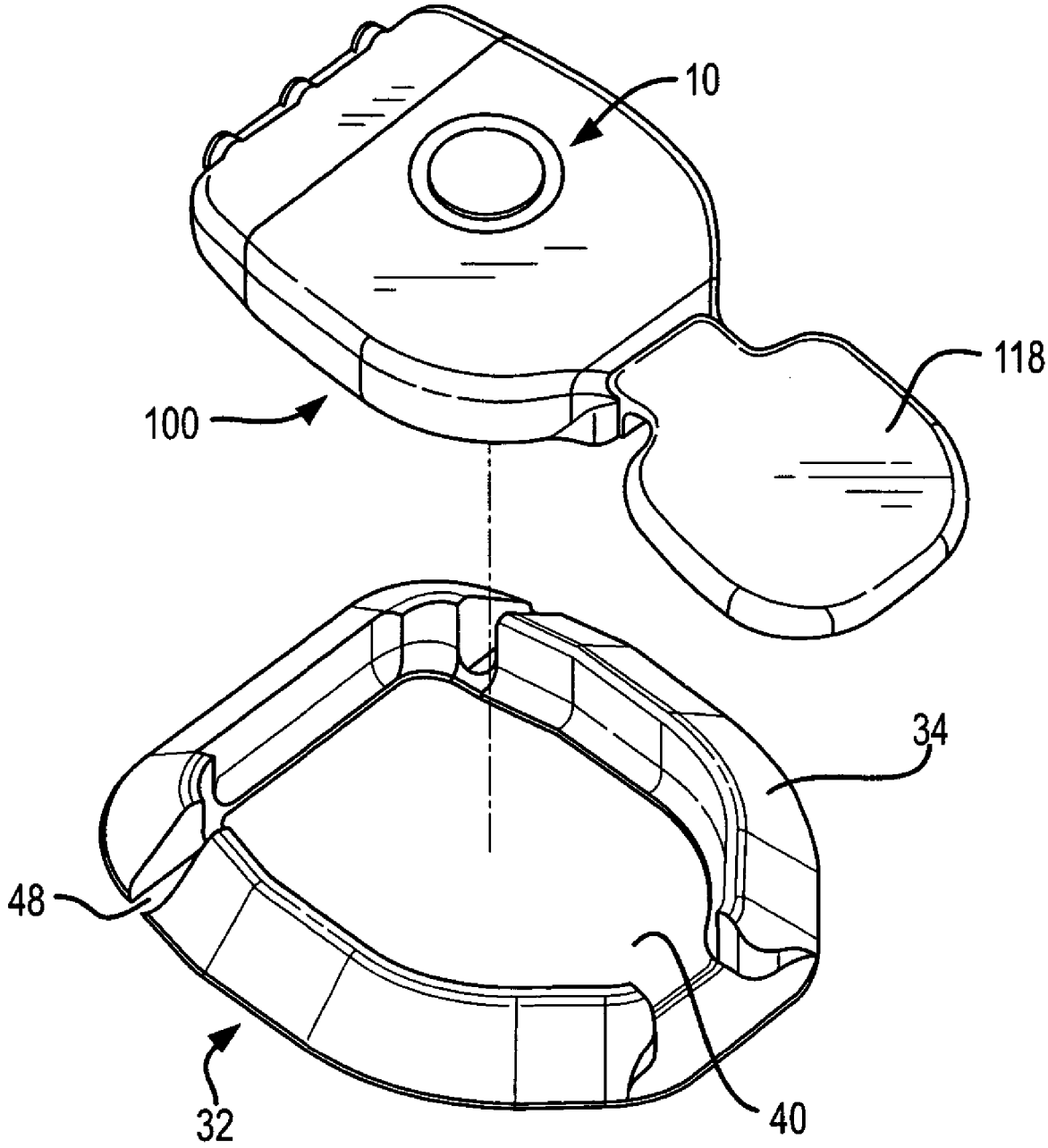
FIG. 2 illustrates a perspective view one embodiment of an implantable housing.
Figure 3:
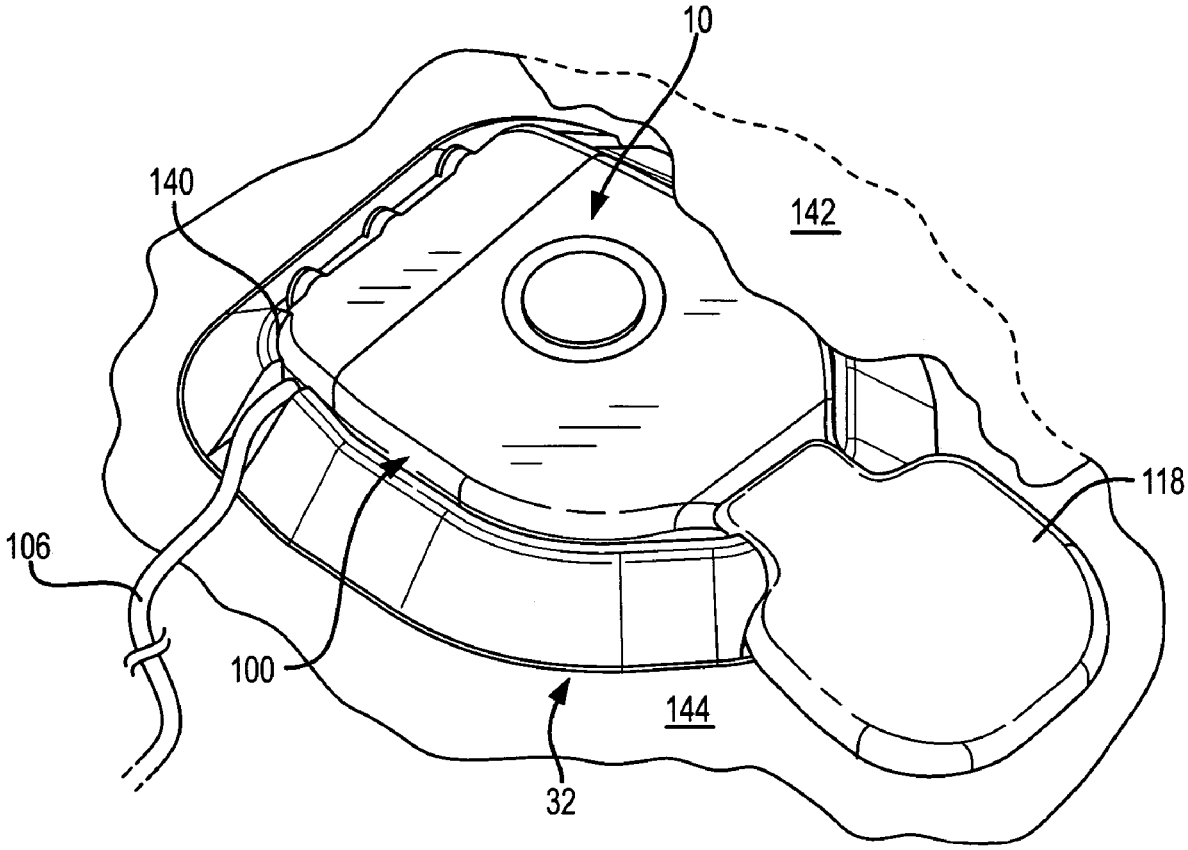
FIG. 3 illustrates the implantable housing of FIG. 2 as implanted relative to patient tissue.

Hearing Instrument System:

FIGS. 1–3 illustrate one application of the present invention. As illustrated, the application comprises a fully implantable hearing instrument system. As will be appreciated, certain aspects of the present invention may be employed in conjunction with semi-implantable hearing instruments as well as fully implantable hearing instruments, and therefore the illustrated application is for purposes of illustration and not limitation.

In the illustrated system, an implanted biocompatible housing 100 (i.e., implant housing) is located subcutaneously on a patient's skull. The implant housing 100 includes a receiver 118 (e.g., comprising a coil element), an energy storage device (not shown), a microphone including a microphone diaphragm 10, and a signal processor (not shown) including a speech signal-processing (SSP) unit (i.e., in addition to processing circuitry and/or a microprocessor). Various additional processing logic and/or circuitry components may also be included in the implant housing 100 as a matter of design choice. The signal processor is electrically interconnected via wire 106 to an electromechanical transducer 108. Alternatively, however, the transducer 108 may be any type of transducer operative to stimulate a component of the auditory system such as the tympanic membrane, ossicies 120 or cochlea.

The transducer 108 is supportably connected to a positioning system 110, which in turn, is connected to a bone anchor 116 mounted within the patient's mastoid process (e.g., via a hole drilled through the skull). The transducer 108 includes a connection apparatus 112 for connecting the transducer 108 to the ossicles 120 of the patient. In a connected state, the connection apparatus 112 provides a communication path for acoustic stimulation of the ossicles 120, e.g., transmission of axial vibrations to the incus 122.

As shown in FIGS. 2 and 3, an optional compliant base member 132 is utilized to reduce non-ambient vibrations that may be transmitted from an implant wearer's skull (i.e., skull-borne vibrations) and/or tissue to the implant housing 100 and, hence, the microphone diaphragm 10. The compliant base member 132 is designed to receive the implant housing 100 within a cup-shaped recess 140 and hold the implant housing 100 such that the microphone diaphragm 10 is positioned to receive ambient acoustic signals through overlying tissue. Further, the compliant base member 32 includes a channel 48 through the periphery of the recess 40 that allows wire 106 to be routed from the implant housing 100 to the transducer free of obstruction. In FIG. 3 the compliant base member 132 and implant housing 100 are shown as they would appear in use in relation to a patient's skull 144, and overlying tissue/skin 142 (e.g., shown in cut-away relation).

During normal operation, acoustic signals are received subcutaneously at the microphone diaphragm 10. Upon receipt of the acoustic signals, the implanted signal processor processes the signals (e.g., using the SSP unit) to provide a processed audio drive signal via wire 106 to the transducer 108. As will be appreciated, the SSP unit may utilize digital processing to provide frequency shaping, amplification, compression, and other signal conditioning, including conditioning based on patient-specific fitting parameters. The audio drive signals cause the transducer 108 to transmit vibrations (e.g., axial) at acoustic frequencies to the connection apparatus 112 to effect the desired sound sensation via mechanical stimulation of the incus 122 of the patient.

An external charger (not shown) may be utilized to transcutaneously re-charge the energy storage device within the implant housing 100. Such an external charger may include a power source and a transmitter that is operative to transcutaneously transmit, for example, RF signals to the implanted receiver 118. In this regard, the implanted receiver 118 may also include, for example, rectifying circuitry to convert a received signal into an electrical signal for use in charging the energy storage device. The external transmitter and implanted receiver 118 may each comprise coils for inductive coupling of signals there between. In addition to being inductively coupled with the inductive coil 118 for charging purposes, such an external charger may also provide program instructions to the processor(s) of the implantable hearing instrument.

Figure 4:
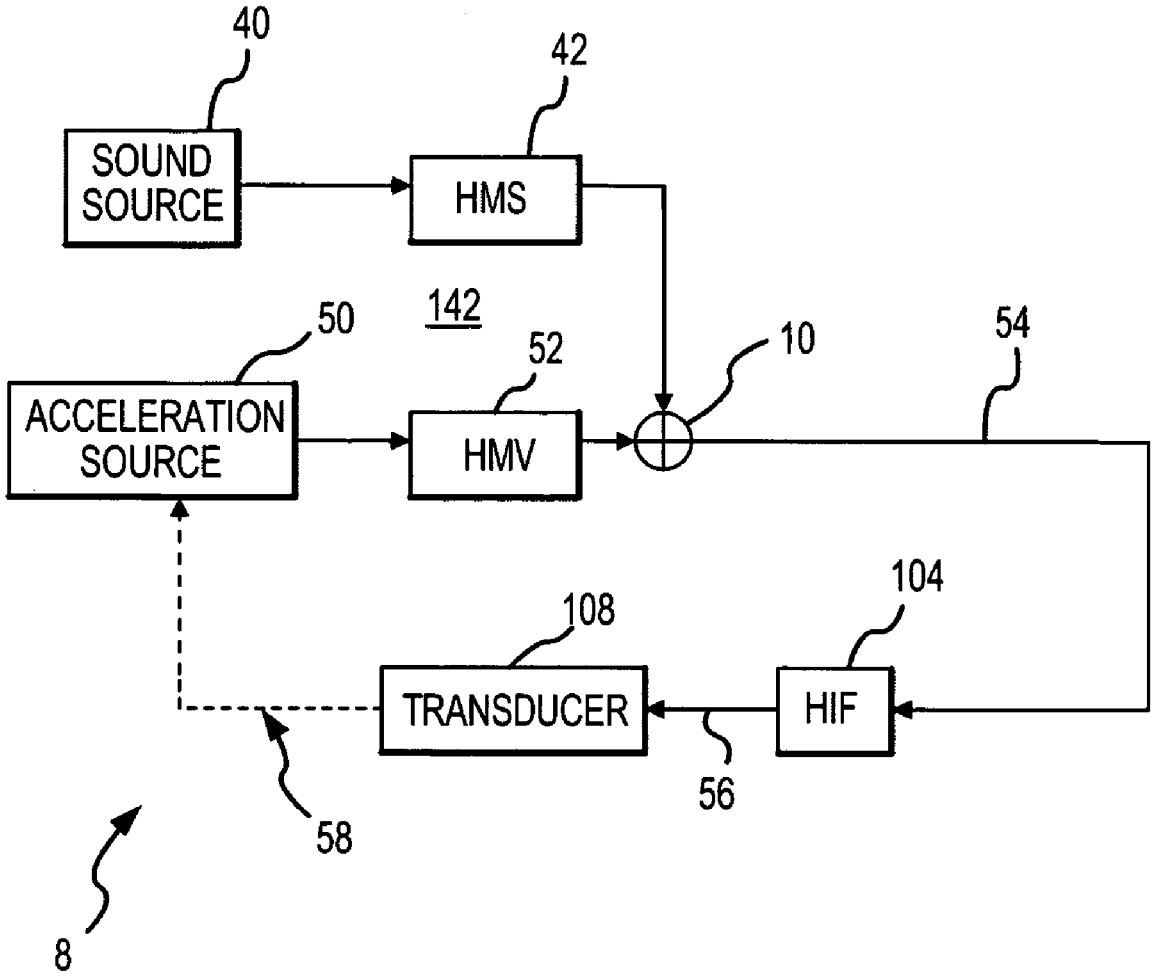
FIG. 4 illustrates a signal flow block diagram of one embodiment of an implantable hearing instrument.

The block diagram FIG. 4, illustrates how pressures resulting from ambient acoustic sounds and tissue-borne acceleration are combined at an implanted microphone diaphragm 10 of an implantable microphone assembly 8. As shown, the implanted microphone diaphragm 10 is exposed to pressure in overlying tissue 142 that is generated externally to the patient, represented by ambient sound source 40. This ambient signal (e.g., sound) from the sound source 40 passes through and is filtered by the tissue 142 overlying the microphone diaphragm 10. The deflection of the microphone diaphragm 10 by the pressure associated with the ambient sound results in a desired signal component, or, microphone sound response 42. This microphone sound response 42 is also mixed with the pressure generated by acceleration in the overlying tissue 142 caused by one or more acceleration sources 50. The pressure from the acceleration source 50 is likewise filtered by the tissue 142 overlying the microphone diaphragm 10 and results in an undesired signal component or microphone vibration response 52 (Hmv).

The net effect is that the signals 42, 52 are summed by the normal action of the microphone diaphragm 10. That is, pressure associated with each of the ambient signal and acceleration signal, which arrive at the microphone diaphragm 10 through the overlying tissue 142, deflect the diaphragm 10 and thereby generate a microphone output signal 54. The microphone output signal 54 is a combination of the pressure associated with the two received signals 42, 52.

The microphone output signal 54 is processed by the processor 104 of the implantable hearing instrument. Such processing may include, without limitation, functions such as band pass filtering, equalization and compression. Once the hearing instrument processing is performed on the microphone output signal 54, the output 56 of the processor 104 drives the transducer 108, which may include, for example, a middle ear transducer or cochlear implant electrode array.

The acceleration source 50 may comprise any source of tissue-borne vibrations and may include biological sources and mechanical sources. Such biological sources may include, without limitation, chewing and speaking. One example of a mechanical source includes feedback signals from the transducer 108, which in the normal course of its operation may vibrate surrounding tissue. Such vibration may subsequently be conducted to the location of the microphone diaphragm 10. Such a feedback path 58 is illustrated with a dotted line in the block diagram of FIG. 4. If the feedback is of sufficient strength and phase, feedback oscillation may occur (see e.g. Nyquist). If of sufficient power, such acceleration signals will present themselves as impairments to the performance of the hearing instrument. Further, if they are of sufficient power, such acceleration signals may saturate the microphone.

As noted above, tissue-borne vibration and ambient sound signals each induce pressure fluctuations within the tissue 142 overlying the microphone diaphragm 10. As further noted, the microphone diaphragm 10 detects the combination of these pressure fluctuations as a single varying pressure. In order to detect desired signal components (e.g., the microphone sound response 42) with sufficient sensitivity, the implanted microphone needs to compensate for undesired signal components (e.g., the microphone vibration response 52). Stated otherwise, the microphone assembly 8 needs to separate ambient acoustic signals from tissue-borne vibration-induced signals. In order to separate these signals, one element of the microphone assembly 8 is designed to be preferentially sensitive to vibration and preferentially insensitive to acoustic stimulation.

The present invention utilizes a reference or 'cancellation surface' that is primarily sensitive to tissue-borne vibration (i.e., acceleration) while being substantially insensitive to ambient acoustic signals. In this regard, output from the cancellation surface may be removed from a combined output 54 from a diaphragm 10 that is sensitive to pressure variations associated with both ambient acoustic signals and acceleration signals. Accordingly, by monitoring the differences in, for example motion, force, distance, velocity, volume or other properties of the diaphragm 10 and the cancellation surface, variation in the diaphragm caused by ambient acoustic signals may be effectively extracted from a combined output signal 54 of the microphone diaphragm 10. Accordingly, this difference (e.g., the ambient acoustic signal) may be output to the implanted signal processor 104 for additional processing and/or output to the transducer 108 for use in stimulating a component of a patient's auditory system.

Figure 5:
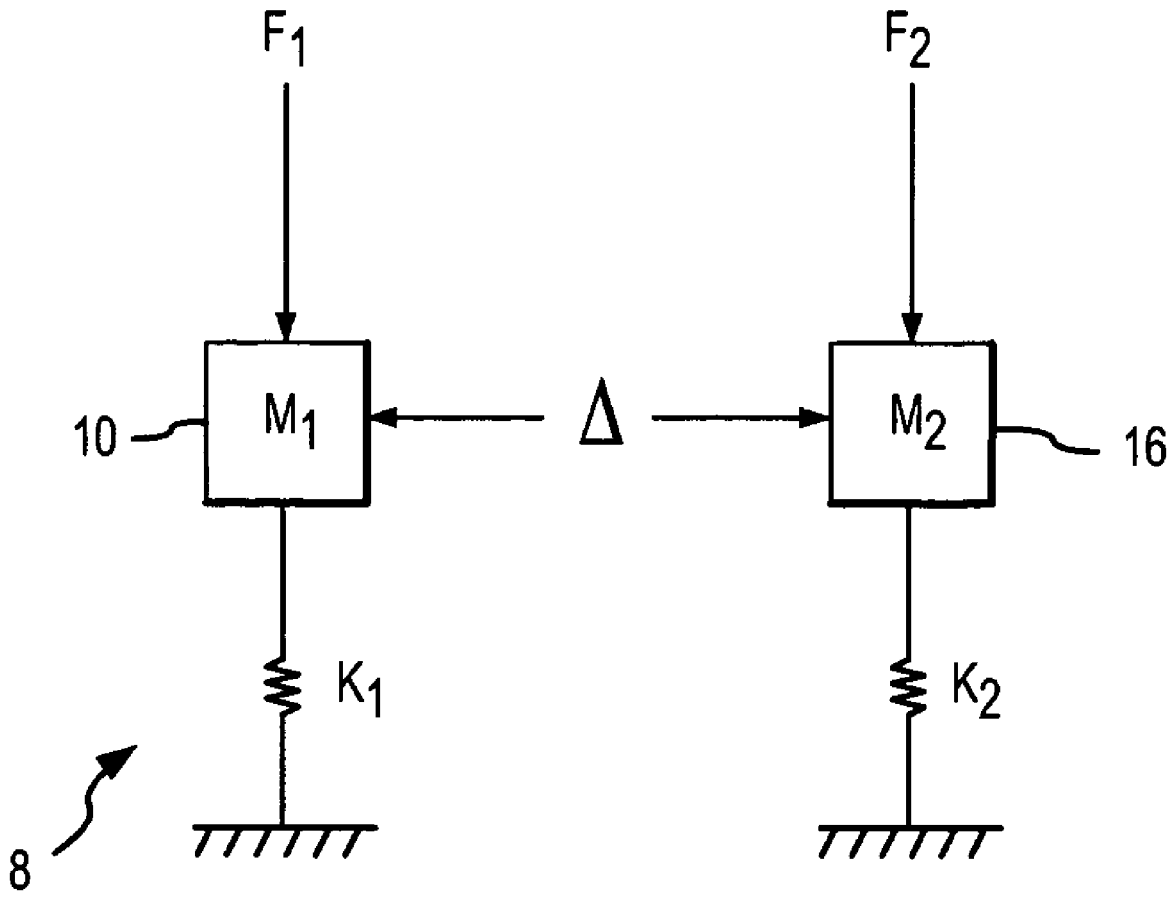
FIG. 5 illustrates a mathematical model of the present invention.

FIG. 5 shows a schematic/mathematical depiction of the basic operating principle of a microphone assembly 8 that utilizes a cancellation surface 16. As shown, the microphone assembly 8 can be modeled as a spring mass system where the diaphragm 10 and a mass of overlying tissue is a first mass $M_1$ having a first spring constant $k_1$. The diaphragm 10 may be positioned immediately adjacent and facing to the skin of the patient such that a combined force $F_1$ including ambient acoustic signals and acceleration acts upon $M_1$. The cancellation surface 16 is disposed within the microphone assembly 8 such that it is substantially isolated from ambient acoustic signals (e.g., within an implant housing). In this regard, the cancellation surface 16 is represented by $M_2$, has a second spring constant $k_2$, and is acted upon by $F_2$, which is the force due to acceleration.

As will be appreciated, the response of the two systems $M_1$ and $M_2$ is governed by simple harmonics. It can be shown mathematically that when the microphone assembly 8 measures a frequency significantly higher that the resonant frequencies of the systems $M_1$, $k_1$ and $M_2$, $k_2$, the difference $\Delta$ between the systems (e.g., velocity in one embodiment) may be determined and is independent of spring rates and masses of the systems. Accordingly, the difference $\Delta$ between the cancellation surface 16 and the diaphragm 10 will represent the pressure applied to the diaphragm 10 by ambient acoustic signals. That is, the difference $\Delta$ represents the ambient acoustic signal applied to the diaphragm 12 free of pressure variations caused by acceleration. In this regard, by monitoring the difference $\Delta$ of the systems $M_1$ and $M_2$ the acoustic signal may be determined substantially free of acceleration. Accordingly, the difference $\Delta$ may be supplied to the processor 104 and/or transducer 108 for use in hearing augmentation.

Figure 6:
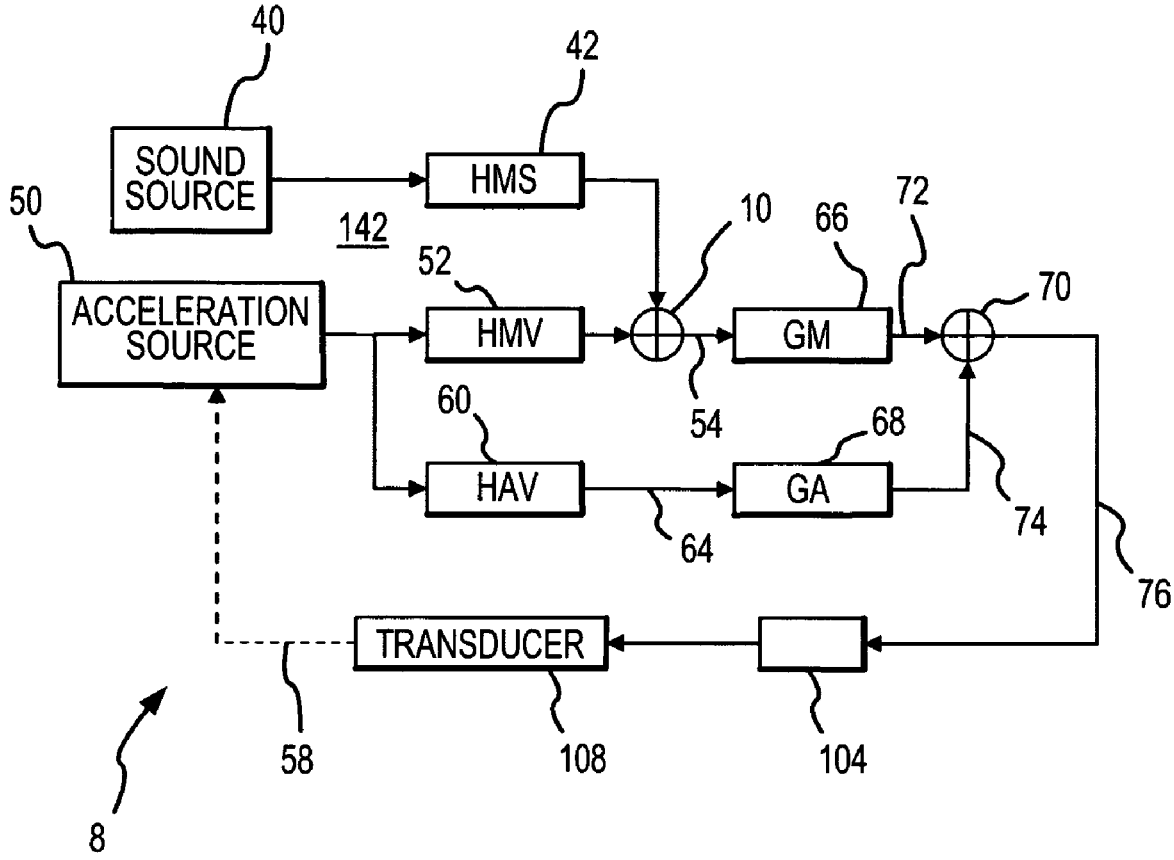
FIG. 6 illustrates a signal flow block diagram of another embodiment of an implantable hearing instrument.

FIG. 6 illustrates a block diagram of one embodiment of a microphone assembly 8 that utilizes a cancellation surface. In this arrangement the cancellation surface, which is capable of responding to acceleration due to vibration while being substantially isolated from ambient sound signals, is represented as an accelerometer 60. As shown, the accelerometer 60 generates an accelerometer output signal 64 in response to the acceleration source 50, which is also represented by Hav (accelerometer vibration response) on FIG. 6. The accelerometer output signal 64 is substantially free of effects of the ambient acoustic signals from the sound source 40. Similar to the situation discussed in FIG. 4, the output signal 54 of the microphone diaphragm 10 is a combination of the pressures associated with the sound source 40 and acceleration source 50. The microphone output signal 54 may optionally be filtered by a microphone post-filter 66 (e.g., transfer function/rational polynomial Gm) operative to adjust, one or more characteristics of the microphone output signal 54 (e.g., gain, phase, etc.). Likewise, the accelerometer output signal 64 may optionally be filtered by an accelerometer post-filter (Ga) to adjust one or more characteristics of the accelerometer output signal 64. Such post-filtering will be more fully discussed herein.

The output signals 54, 64 are combined in a summer 70. The post filter and summer embodiments may comprise mechanical, pneumatic, electrical analog, digital or software, or combinations thereof. Generally, the values of the post-filter coefficients/weights are selected so that to a substantial degree in the frequency range of interest (i.e., an acoustic hearing range) the post filter outputs 72, 74 have substantially equal magnitude and/or phase where:

$$Hmv\ Gm = -Hav\ Ga \quad \text{(Eq 1)}$$

The sign change in this equation may be provided in the output/response of the accelerometer 60, the microphone diaphragm 10, either of the filters 66, 68, or, the summer 70 may have the polarity inverted on one input. In this regard, the summer 70 performs as a subtractor. If the equation holds to a substantial degree in the frequency range of interest, then the response of the microphone assembly 8, consisting of microphone sound response Hms(s) 42, microphone vibration response Hmv(s) 52, accelerometer vibration response Hav(s) 64, microphone post-filter output 72, accelerometer post-filter output 74 and summer output 76 is essentially just the response of the microphone diaphragm 10 to the sound source 40. That is, the response of the microphone assembly 8 is the response of the microphone diaphragm 10 to the sound source 40 alone. There is a large degree of flexibility of how a microphone assembly may be constructed, based on various design choices presented by Equation 1. Some of the possible design choices are presented herein.

In one case, the acceleration response of the microphone diaphragm 10 and accelerometer 60 are made substantially identical, while the post filters 66, 68 are a substantially equal value of −G (including the possibility of G=k, a constant, and further including the case k=1) for both post filters 66, 68. That is:

$$Hav = Hmv,\ Gm = Ga = -G \quad \text{(Eq2)}$$

(Where, equality is assumed to mean substantial equality over the frequency range of interest.) This includes the case where the acceleration responses of the microphone diaphragm 10 and accelerometer 60 are mechanically selected to be substantially equal, but have opposite sign due to the mechanical construction, and where the output signals 54, 64 are mechanically summed, with essentially no filtering. Where there is no filtering, the post-filters 66, 68 may be eliminated.

While making the acceleration response of the microphone diaphragm 10 and accelerometer 70 equal is relatively easy for frequencies substantially above the resonant frequency of the microphone diaphragm 10, achieving a resonant frequency low enough to cover the frequency range of interest while maintaining sufficient desired signal strength can be problematic. The frequency range of interest usually includes the band of 1 kHz and higher, whereas the resonant frequency of the microphone diaphragm is generally limited to higher frequencies due to the limited volume of the microphone assembly (i.e., for generating an acoustic output in response to received via overlying tissue) and the mass of the overlying tissue, coupled with the necessity to maintain sufficient acoustic sensitivity.

In another case, the acceleration response 52 (Hmv) of the microphone diaphragm is corrected by the post-filter 66 to be an essentially flat gain k. That is:

$$Hmv\ Gm = k,\ Hav\ Ga = -k \quad \text{(Eq 3)}$$

This has the advantage of flattening the sound response of the microphone diaphragm 10 as well, since the ratio of the sound pressure response to acceleration response is approximately constant. This is normally advantageous to any subsequent processing by the processor 104, as it optimizes the dynamic range of an analog to digital converter (not shown), which converts the generally analog output signals to digital values for processing, and optimizes the numeric processes involved in equalization and any intervening processing. A similarly flattened signal is generated by the accelerometer branch of the microphone assembly 8, so that output of the accelerometer post-filter 68 is corrected to the same essentially flat gain k, but have opposite sign. Making the outputs 72, 74 of each of the microphone diaphragm branch and accelerometer branch essentially flat with frequency also has the advantage of reducing the sensitivity of the cancellation process to variations in any of the subcomponents. This approach also has the advantage of being simple to adjust, in that the response of each of the microphone diaphragm and accelerometer branches can be adjusted to have a flat response independently.

In another case, no post filtering is provided to the microphone diaphragm branch other than a gain k with an allpass filter. That is:

$$Hmv\ Gm=k,\ Hav\ Ga=-k \qquad \text{(Eq 4)}$$

This has the advantage of not altering the sound response of the microphone assembly 8. It has the further advantage of concentrating the filter coefficients into a single branch. This may be important, depending on the implementation, in minimizing, say, the processing power required, and may be a preferred embodiment for systems in which the post-filters 66, 68 and second summer 70 are implemented digitally or in software. The allpass function is chosen to correct for any phase shifts due to the filtering process, as often it is not possible to exactly invert the filter Hav and remain causal. An example of such an allpass filter may be a time delay, with a time delay selected to correct for any time delays introduced into the accelerometer branch.

It should be noted that in most implementations, the responses 42, 52 (Hmv and Hav) of the microphone diaphragm 10 in the frequency range of interest will change with changing thickness of tissue over the microphone diaphragm 10. Both the sound and acceleration responses of the microphone diaphragm 10 can change in a complex manner, with the strength and position of resonances changing. In general, the frequency of the resonances will decrease with increasing skin thickness, approximately inversely proportional to the square root of the skin thickness. The amplitude of the response will increase approximately proportional to the thickness of the skin. Generally, the response of a simple microphone diaphragm, operated as a membrane or plate, has multiple, complicated, resonances when incorporated into an implanted microphone assembly. Such resonances, unless matched in the accelerometer response, will result in a reduction of the cancellation of the microphone accelerometer response.

The resonances of the microphone diaphragm 10 can be moved to a frequency range above the frequency range of interest (i.e., an acoustic frequency range) by increasing the tension and/or stiffness of the microphone diaphragm 10 substantially, resulting in a flatter and easer-to-match response, but this is found to reduce the acoustic sensitivity of the microphone assembly 8. By using mechanical filtering, the response of the microphone diaphragm is considerably simplified, making matching the response with the accelerometer response much easier. Such filtering can be achieved mechanically by, for instance, changing the distribution of stiffness and/or the damping of the diaphragms used.

The goal of mechanical filtering in general is to simplify the task of matching the microphone acceleration response with the accelerometer response, or in subsequently matching the output 72 of the microphone post-filter 66 to the output 74 of the accelerometer post-filter 68. With a microphone acceleration response achieved, the accelerometer 70 is designed to have a similar response. Then, either or both of the responses can be further post filtered by e.g. pneumatic, mechanical, electrical or digital means so that the filtered responses result in cancellation of the microphone acceleration response to a desired degree. In any case, it is desirable that the response of the microphone diaphragm to acceleration and the response of the accelerometer to acceleration be closely matched such that post-filtering may be facilitated or eliminated.

FIGS. 7–11 disclose various embodiments of vibration compensating microphone assemblies. As shown in FIGS. 7, 8A, 8B, 10 and 11, the microphone assemblies are constructed in a manner that substantially matches the magnitude and phase of the cancellation surface/accelerometer response to the acceleration response of the microphone diaphragm.

Figure 7:
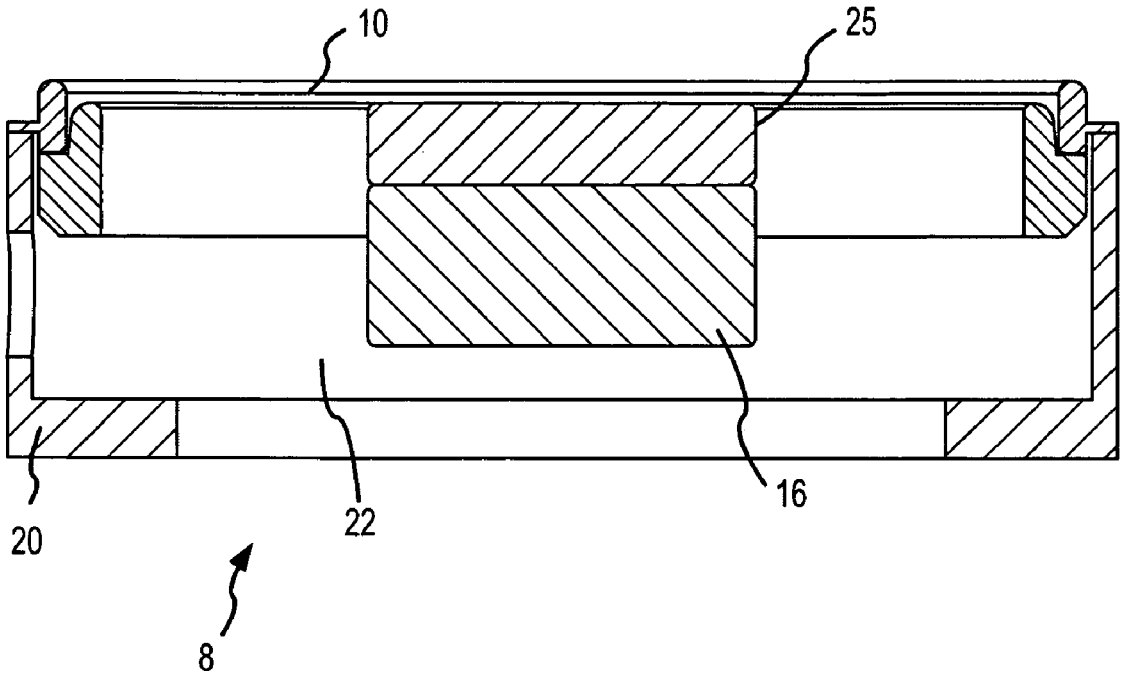
FIG. 7 illustrates a cross-sectional view of one embodiment of the present invention.

FIG. 7 shows a first embodiment of a vibration compensating microphone assembly 8. In this embodiment, the microphone assembly 8 measures the difference in motion between the center of a microphone diaphragm 10 and a cancellation mass 16 (i.e., an accelerometer). The cancellation mass is also know variously as a proof mass or a seismic mass. As shown, the microphone assembly 8 includes a housing 20 that defines an internal chamber 22. The chamber 22 includes an aperture across which the microphone diaphragm 10 is sealably disposed. A compressible foam electret material 25 is interconnected to the center of the microphone diaphragm 10. Interconnected to an opposing surface of the electret material 25 is the cancellation mass 16 that forms the cancellation surface for the depicted microphone assembly 8.

In this embodiment, the resonant frequency of the microphone diaphragm 10, which is mass loaded due to the surrounding media (i.e., tissue), is selected to be significantly below the lowest frequency of interest. Likewise, the resonant frequency of the cancellation mass 16 is also chosen to be significantly below the lowest frequency of interest. Furthermore, it will be noted that the size of the cancellation mass 16 may be selected for resonant frequency purposes. Ideally, the resonant frequency of the microphone diaphragm 10 and the cancellation mass 16 are substantially equal. However, it will be appreciated that the resonant frequency of the microphone diaphragm 10 and cancellation mass 16 need not be the same.

The difference in motion between the microphone diaphragm 10 and the cancellation mass 16 is measured using the electret material 25. In this regard, the electret material 25 acts as a sensor that measures the relative movement between the connected portions of the cancellation mass 16 and diaphragm 10. If the mass of the cancellation mass 16 is substantially equal to the mass (i.e., tissue) overlying the diaphragm 10, the responses of these elements 10, 16 to acceleration from an acceleration source may be substantially equal. In this regard, the resulting force on the electret material 25 may correspond primarily to ambient acoustic signals acting on the diaphragm 10. The output of the electret likewise may be indicative of the response of the microphone diaphragm 10 to ambient acoustic signals free of acceleration.

As shown, the electret material 25 acts as a piezo-active material. Accordingly, by measuring the changes in voltage between the membrane 12 and the cancellation surface 16, differences Δ in motion between the diaphragm 10 and the cancellation surface 16 may be directly monitored thereby generating an output signal that may be utilized for hearing augmentation purposes. As will be appreciated, in order to measure a voltage across the foam electret material 25, the cancellation surface 16 may form a first electrode and the diaphragm 10 may form a second electrode.

Figure 8A:
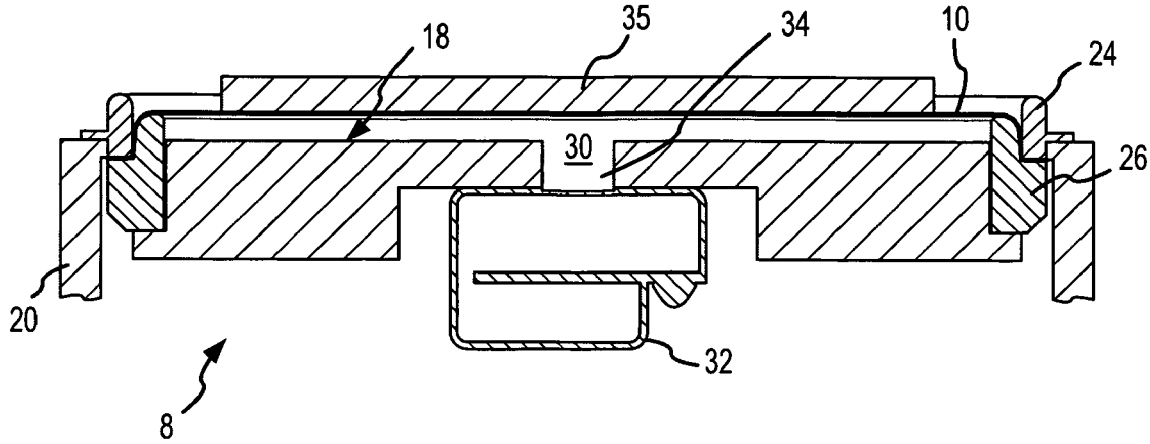
FIGS. 8A and 8B illustrate a cross-sectional view of a second embodiment of the present invention.
Figure 8B:
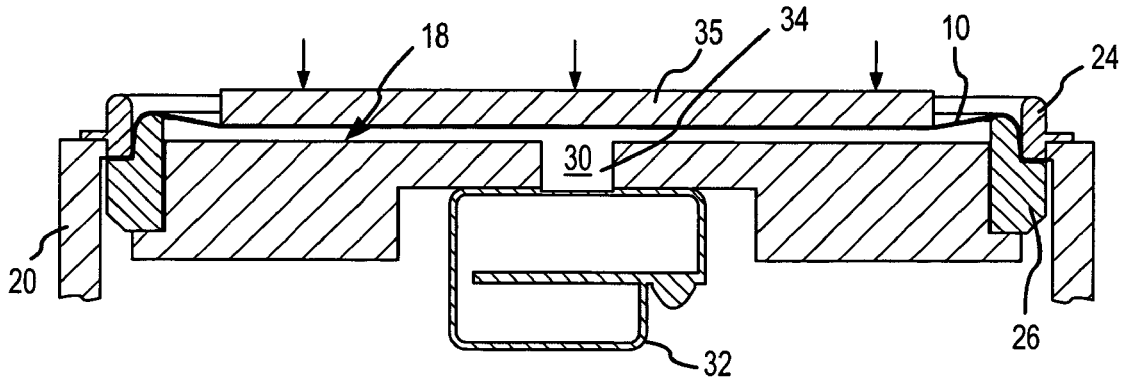

FIGS. 8A and 8B illustrate another embodiment of a vibration compensating microphone assembly 8. As shown, the microphone assembly 8 forms what may be termed a trapped volume acceleration microphone assembly. In this regard, the microphone assembly 8 utilizes two elements moving in parallel. One of the elements is responsive to acoustic signals and acceleration/vibration while the other element is only responsive to acceleration/vibration. Specifically, the acoustic and acceleration sensitive element is the microphone diaphragm 10, which, as shown, also serves as a hermetic seal for a microphone housing 20 isolating an internal chamber of the microphone assembly 8 from the user's body. The vibration sensitive element is a mass loaded second diaphragm or cancellation diaphragm 18 (i.e., accelerometer) disposed inside and parallel to the microphone diaphragm 10. The mass loading allows the cancellation diaphragm 18 to move in response to acceleration forces applied to the housing 20.

Generally, the movement of the microphone diaphragm 10 and the cancellation diaphragm 18 in response to acceleration will be substantially equal, if the mass loading on these elements 10, 18 is substantially equal. Accordingly, displacement of the diaphragm 10 due to acoustic signals will result in relative movement between the diaphragm 10 and the cancellation diaphragm 18. This relative movement is indicative of the acoustic signal. Accordingly, by measuring the relative movement (e.g., displacement of diaphragm 10) the acoustic signal may be isolated.

The microphone diaphragm 10 and the cancellation diaphragm 18 together form an enclosure 30 having a finite volume. The microphone assembly 8 may monitor changes in the physical configuration of the enclosure 30 to extract an acoustic signal from the acoustic and acceleration signals received by the microphone diaphragm 10 and provide the extracted acoustic to an implanted hearing system for use in hearing augmentation. That is, rather than measuring acceleration directly and subtracting the acceleration from a combined acoustic and acceleration signal, changes in a physical configuration of the enclosure 30 may be detected and utilized as an acoustic output signal.

One method of measuring changes in the physical configuration includes monitoring changes in the volume of the enclosure 30. Generally, any fluid trapped between the microphone diaphragm 10 and the cancellation diaphragm 18 will tend to be forced inward or outward in response to the relative movement of these diaphragms 10, 18. The change in the volume of the enclosure 30 may be measured in any appropriate manner. Examples include measuring the pressure in the trapped volume using a conventional microphone element or by the detection of the displacement by measuring the changes in electrical capacitance between the two diaphragms.

As shown in FIGS. 8A and 8B, a microphone element 32 is acoustically coupled to the enclosure 30 via an aperture 34 through the bottom surface of the cancellation diaphragm 18. The size and dimension of the aperture 34 may be selected to, in conjunction with the microphone element 32, provide a concentrated mass near the center of the cancellation diaphragm 18. Furthermore, if additional mass is desired or required for mass loading the cancellation diaphragm 18 (e.g., for resonant frequency purposes), a distributed mass may also be utilized. This may be supplied by a layer of silicone gel, or other appropriate materials that may be applied to the bottom surface of the cancellation diaphragm 18. It should be will be noted that the microphone element 32 could be acoustically interconnected to the enclosure 30 through an edge of the enclosure (i.e., at a common perimeter of the diaphragms 10, 18). This may provide benefits in matching the resonant frequencies and/or providing for more equal movement of the diaphragms 10, 18.

The microphone diaphragm 10 and cancellation diaphragm 18 are clamped to a microphone housing 20 utilizing an outer clamp ring 24 and an inner-clamp ring 26. To maintain a space between the external diaphragm 12 and the cancellation diaphragm 18, a spacer washer may be utilized (not shown). Such a spacer washer may also electrically isolate the diaphragms 12, 18 and/or may be placed near the peripheries of the diaphragms 12, 18. Further, such a spacer washer may be a compliant member that provides damping and can provide a resonant frequency boost wherever needed in the acoustic spectrum. For example, an elastomeric spacer may allow acoustic resonance to be placed as 2–4 kHz, thereby increasing gain in that segment of the speech band where most speech information is contained.

As will be appreciated, the peripheries of the diaphragms 10, 18 will typically accelerate equally and will therefore not contribute to a net change in volume due to acceleration. At the same time, motion of the perimeter of the surface of the microphone diaphragm 10 does not contribute to the acoustic sensitivity of the microphone assembly 8. At frequencies significantly above the resonant frequency of both diaphragms 10, 18, the center of the diaphragms 10, 18 will stay largely motionless due to the inertia of the mass loading of each diaphragm 10, 18. Hence, they will not contribute to a net change in volume due to acceleration. Further, if the structure of each diaphragm 10, 18 is selected such that their deformities under acceleration are similar, then they will not contribute to a net change in volume due to acceleration as both the perimeter and center of the diaphragms 10, 18 must move equally as discussed above.

It has been found that making the microphone diaphragm 10 much stiffer except at the periphery removes complicating resonances to frequencies that are above the frequency range of interest while minimally impacting the acoustic sensitivity of the microphone assembly 8. As shown, this is achieved by attaching a reinforcing plate or reinforcing disc 35 to the surface of the microphone diaphragm 10. Generally, the reinforcing disc 35 will have a stiffness that is greater than the stiffness of the diaphragm 10. Such attachment may be by permanent coupling or may utilize a viscous coupling (such as a thin layer of silicone or grease), which results in sufficient shear dissipation to dampen high resonances. It will be further appreciated that the use of the disc 35 also allows the microphone diaphragm 10 to maintain a shape that remains substantially the same as the cancellation diaphragm 18. That is, the displacement of the microphone diaphragm 10 (see FIG. 8B) due to ambient acoustic signals will not significantly deform the shape of the microphone diaphragm 10 in relation to the cancellation diaphragm 18. Further, it has been determined that the correlation between the response of the microphone diaphragm 10 to acceleration and the response of the cancellation diaphragm 18 to acceleration is highest when the shapes of these members 10, 18 are substantially the same.

In order to achieve the greatest degree of reduction of the acceleration signal, it may be desirable that the net displacement of each diaphragm 10, 18 be similar. This can be achieved by a variety of methods, one of which is to ensure that the diaphragms 10, 18 have similar shapes. In this regard, every point on the microphone diaphragm 10 may have a corresponding point on the cancellation diaphragm 18 that moves an equal amount in relation to acceleration. As a result, there will be very little net change in the enclosure 30 due to acceleration. Further, if the microphone diaphragm 10 is formed as a thin plate having restoring forces due to bending and stretching, the cancellation diaphragm 18 desirably should be made in a similar manner such that both diaphragms 10, 18 exhibit similar response to applied forces. As a further example, if the microphone diaphragm 12 behaves as a membrane having restoring forces due to tension alone, then the cancellation diaphragm 18 should also behave as a membrane. The areas of stiffness and mass loading should desirably be the same as well. In this regard, it may be preferable that the entire bottom surface of the cancellation diaphragm 18 be covered to replicate the mass loading of the diaphragm 10.

Mass loading the entire bottom surface of the cancellation diaphragm 18 may be achieved using an elastomeric material such as a silicone gel. Alternatively, the mass loading may comprise a dense metal backing. For instance, a tungsten backing or tungsten diaphragm 18 may allow for more easily replicating the mass loading on the microphone diaphragm 10. Tungsten has a density that is approximately 8 times greater than water, which is the major component of tissue. Accordingly, a 1 mm tungsten backing provides a mass loading to the cancellation diaphragm 18 that is roughly equivalent of the mass loading of the microphone diaphragm 10 by 8 mm of tissue. Further, it will be noted that the cancellation diaphragm 18 may be made of the same material as microphone diaphragm 10 (e.g. titanium) or be made of other materials such as metal foils, plastic films, elastomers, and closed cell foams so long as the cancellation diaphragm is designed to have properties that approximate displacement of the mass loaded (i.e., tissue loaded) microphone diaphragm 10.

When a pressure originating from an external acoustic sound is presented to the microphone diaphragm 10, the position of the microphone diaphragm 10 will change. That is, the microphone diaphragm 10 will be displaced. The cancellation diaphragm 18 may deform as well, but to a lesser degree. In any case, the displacement of the diaphragm 10 will result in pressurization of the enclosure 30. As shown in FIG. 8B, this pressurization is measured by the microphone element 32 directly. However, it will be appreciated that distance, force, or a combination of distance and force may be utilized to monitor the change in volume of the enclosure 30. In any case, the changes in enclosure volume represent the acoustic signals received by the microphone diaphragm 10. The microphone element 32 may then generate an output signal that may be processed by the signal processor 104 and utilized by a transducer to stimulate a component of the auditory system. See for example FIG. 1.

Advantageously, in a pressure type microphone assembly 10 such as shown in FIGS. 8A and 8B, the finite volume defined by the enclosure 30 between the diaphragms 10, 18 may be filled with an acoustic media, which acts substantially like a fluid. This acoustic media may be, for example, gas, liquid, an elastomer, or a gel. To advantage, combinations of acoustic media may be used in the enclosure 30. For instance, a moderate viscosity incompressible acoustic fluid may be used to fill most of the enclosure 30, while a gas bubble is used to provide the very low viscosity coupling to the microphone element 32 (or another sensor detecting change in physical configuration). For example, when using a mixture of media, a majority of the enclosure may be filled with an incompressible gel leaving a small gas-filled pocket or bubble at the input port of a pressure sensor. As will be appreciated, use of such a bubble may protect the sensor from becoming filled with gel as well as provide for enhanced pressure sensitivity.

Figure 9:
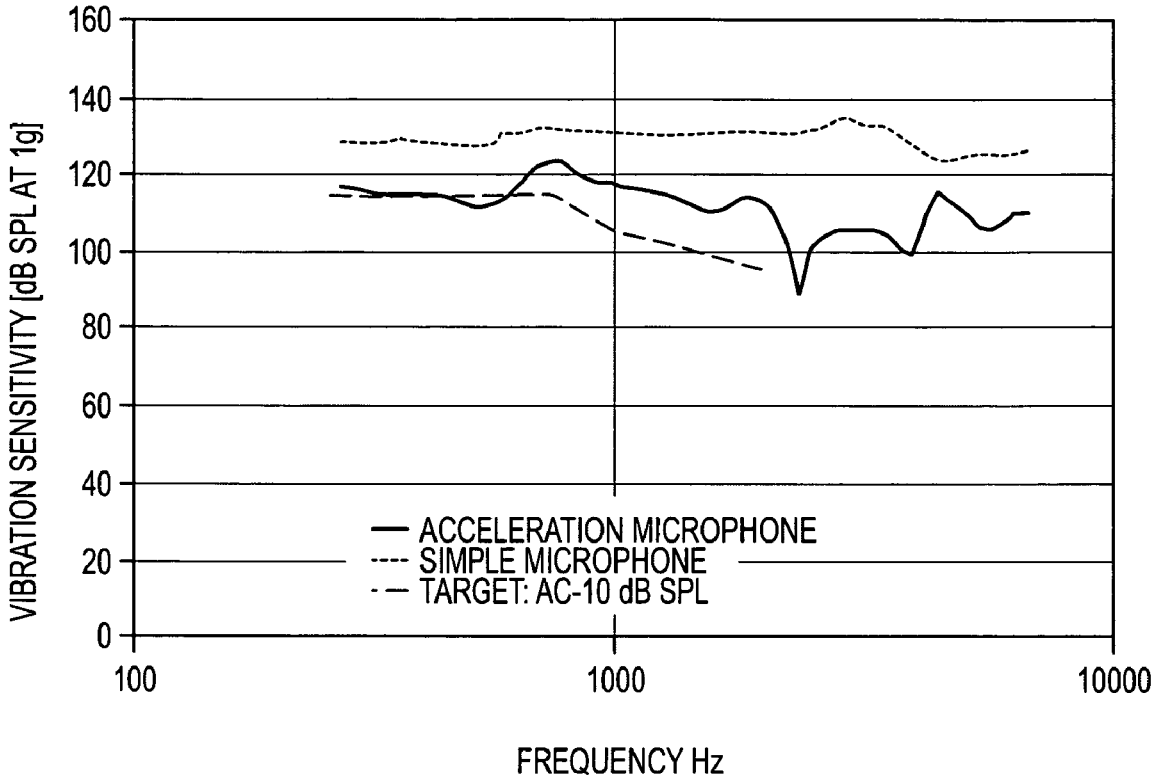
FIG. 9 illustrates a performance plot of the embodiment of FIGS. 8A and 8B.

FIG. 9 shows the results of acoustic and vibration testing of the microphone assembly 8 of FIGS. 8A and 8B in comparison with a simple microphone (i.e., that does not account for acceleration) when these microphones are disposed beneath a tissue-like material having a thickness of about 8 mm. As shown, the vibration sensitivity of the microphone assembly 8 of FIGS. 8A and 8B is superior to that of the simple microphone at all frequencies over the entire frequency range associated with human hearing.

Figure 10:
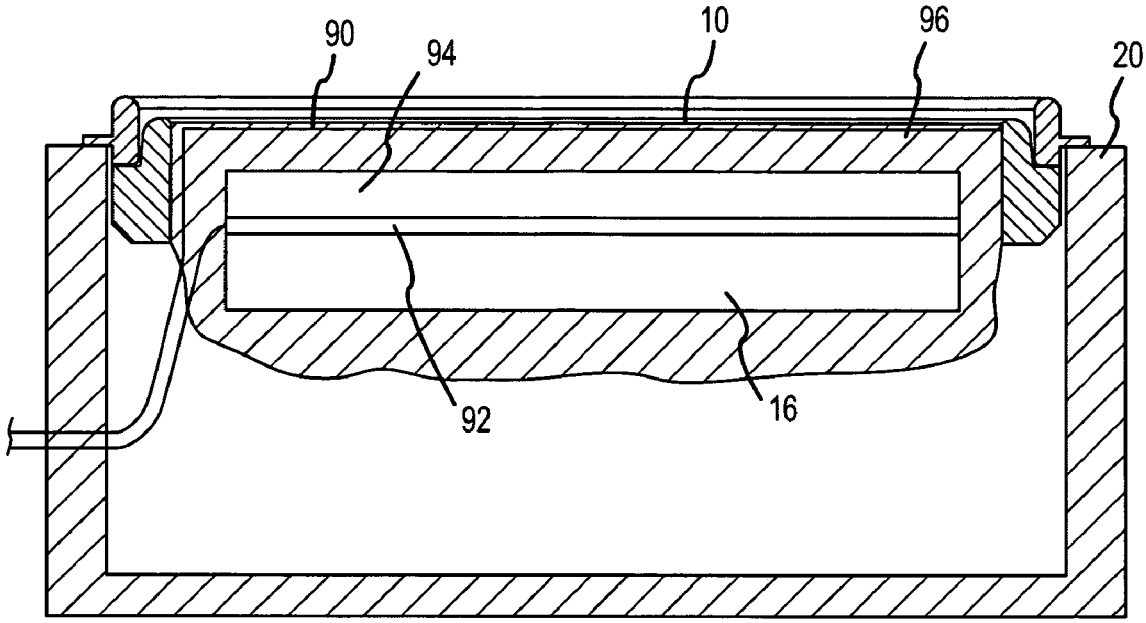
FIG. 10 illustrates a cross-sectional view of a third embodiment of the present invention.

Though discussed herein above in relation to utilizing a standard microphone element 32 in determining pressure differences between the microphone diaphragm 10 and the cancellation diaphragm 18, it will be appreciated that numerous other methodologies may be implemented in determining relative movement between a diaphragm and a cancellation surface, including electrically monitoring such changes. For instance, as shown in FIG. 10 first and second electrodes 90, 92 are disposed on opposing sides of an electrically active material 94 (e.g., a foam electret or piezo-electric member) that is disposed between an external diaphragm 10 and a cancellation mass 16, respectively. To advantage, these electrodes 90, 92 may be incorporated into the diaphragm 10 and/or cancellation mass 16. As shown, the first electrode 90 is formed by electrically interconnecting the diaphragm 10 to an amplifier and the second electrode 92 is formed from a conductive plate disposed between the electrically active material 94 and the cancellation mass 16.

As shown, the space between the diaphragm 10 and the electrically active material 94 is filled with an elastomeric material 96, which also interconnects the cancellation mass to the housing 20. However, it will be appreciated that there may be an enclosed space between these elements, or, that the electrically active material 94 may extend entirely between the diaphragm 10 and the second conductor 92. Further, it will be noted that a second diaphragm may also be utilized instead of a cancellation mass 16.

In this embodiment, deflections of the electrically active material 94 caused by relative movement between the external diaphragm and the cancellation mass 16 will result in a measurable electric output. That is, changes in voltage between the electrodes 90, 92 may be representative of movement of the external diaphragm 10 and absent from the cancellation mass 16. As will be appreciated, in this embodiment the diaphragm 10 and the cancellation mass 16 form what may be considered electrical plates of a capacitor. In this regard, changes in the physical configuration between the two elements 10, 16 are governed by the equation:

$$Q=C\times V \qquad \text{(Eq 5)}$$

where Q is the electrical charge on the electrodes 90, 92;

where C is the capacitance; and where V is the voltage on the electrodes 90, 92.

As will be appreciated, changes in voltage is then given by:

$$DV=dQ/C-Q\times dC/C^2$$

Thus, the changes in charge dQ with a capacitance dC will result in a change in voltage that may be measured and/or utilized as an input signal for a microphone and/or transducer.

In another embodiment, an inductive system (not shown) may be utilized for monitoring the physical configuration between the two diaphragms (i.e., in a closed space embodiment). For instance, changes due to inductance from the motion of a permeable core relative to a coil may be utilized to monitor changes within the enclosure. For instance, a flat "pancake" coil may be disposed on one of the diaphragms. Accordingly, movement of the conductive microphone diaphragm will cause a current within the pancake coil that may be measured and/or utilized as an input to a transducer.

In other embodiments, force may be utilized to measure the changes in the physical configuration between two diaphragms. As will be appreciated displacement cannot occur without force, nor force without displacement. In some cases, however, the force may be considerably larger than the displacement and therefore measuring force rather than displacement may be more desirable. Furthermore, it will be appreciated that a device utilized as a displacement sensor (e.g., pressure sensor) can be used as a force sensor with the addition of a suitable restoring force such as a spring or gas pressure. In this regard, force may be measured by measuring: displaced electrical charge using piezo-electric elements; displaced electrical charge using piezo active elements, such as foam electrets; voltage changes through strain gauges; optical variations using the photo-optic properties of fiber optics, plastics, or moiré detection.

Furthermore, it will be appreciated that the measurements of the physical configuration between two diaphragms may be combined. Such combinations include, but are not limited to, measuring the physical configuration at a single point (e.g., the center of the diaphragms), at several points, distributed over a large area (e.g., utilizing large electrodes and/or disk or ring-shaped electrodes). Furthermore, these values may be combined/processed by a weighted average or using other mathematical functions. As explained above, such processing may be performed by using post filters 66, 68. See FIG. 6.

Figure 11:
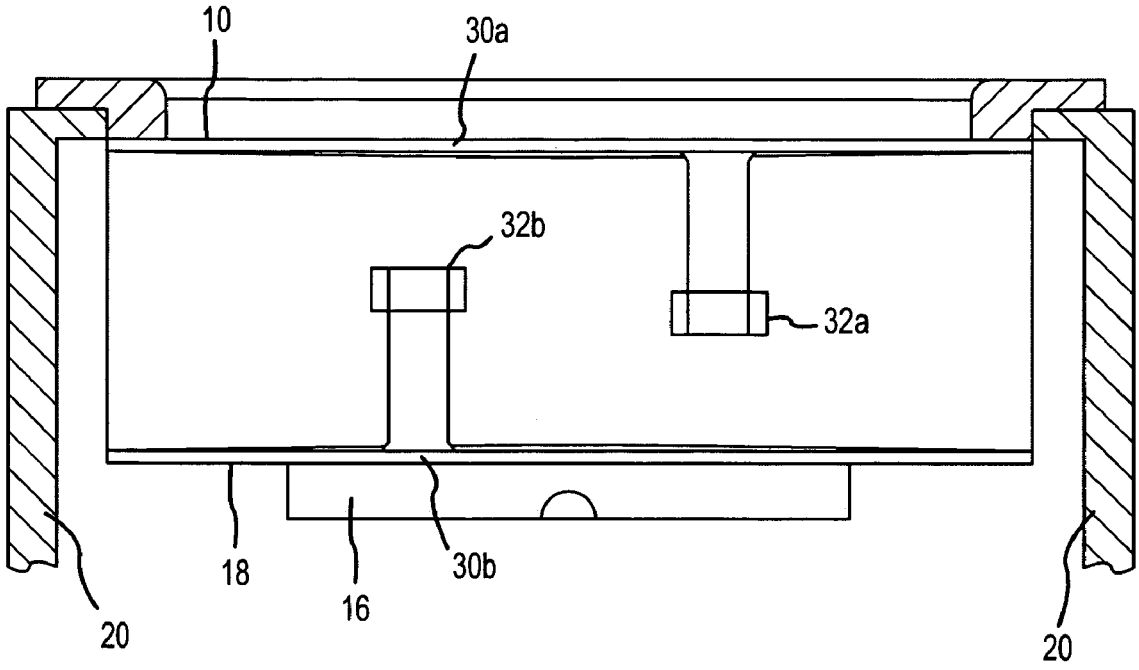
FIG. 11 illustrates a cross-sectional view of a fourth embodiment of the present invention.

FIG. 11 illustrates another embodiment of a vibration compensating microphone assembly that is operative to provide a cancellation response indicative of acceleration that may subsequently be removed from a combined response from a microphone diaphragm, which includes an acceleration response and an ambient sound response. However, as opposed to mechanically/pneumatically combining the cancellation response with the combined response, the responses may be combined electrically.

As shown, the microphone assembly 8 utilizes a first diaphragm 10 that is positioned to be responsive to acoustic signals and acceleration/vibration received through overlying tissue and generate a first output indicative of the acoustic and acceleration signals. More specifically, the microphone diaphragm 10 deflects relative to a first enclosed space 30A. This deflection results in a pressure fluctuation that is monitored by a first microphone element 32A. Accordingly, the microphone element 32A generates a first electrical output corresponding to the movement of the microphone diaphragm 10. As shown, the microphone diaphragm 10 also serves as a hermetic seal for a microphone housing 20.

The microphone assembly also includes a cancellation diaphragm 18 that is mass loaded with a cancellation mass 16 (e.g., proof mass). The cancellation diaphragm is a vibration sensitive element that is disposed inside of the microphone housing 20 such that it is substantially isolated from ambient acoustic signals. The mass loading allows the cancellation diaphragm 18 to deflect in response to acceleration forces applied to the housing 20. Specifically, the cancellation diaphragm deflects relative to a second enclosed space 30B in response to acceleration. This deflection results in a pressure fluctuation in the second enclosed space 30B that is monitored by a second microphone element 32B. Accordingly, the second microphone element 32B generates a second electrical output corresponding to the movement of the cancellation diaphragm 18.

In the embodiment of FIG. 11, the resonant frequency of the microphone diaphragm 10, which is mass loaded due to the surrounding media (i.e., tissue), is again selected to be significantly below the lowest frequency of interest. Likewise, the resonant frequency of the cancellation diaphragm 18 is also chosen to be significantly below the lowest frequency of interest. In this regard, one or more mechanical properties of the cancellation diaphragm 18 and/or the size of the cancellation mass 16 may be selected to achieve a desired resonant frequency. Ideally, the resonant frequency of the microphone diaphragm 10 and the cancellation diaphragm 18 are substantially equal. However, it will be appreciated that the resonant frequency of the microphone diaphragm 10 and cancellation diaphragm 18 need not be the same. In this latter regard, it will be noted that electrically combining the first and second outputs allows individually processing/filtering one or more characteristics (e.g., gain) of each signal. Such individual processing/filtering reduces the need to mechanically match the acceleration response of the cancellation diaphragm 18 with the acceleration response of the microphone diaphragm 10. In this regard, the size of the microphone diaphragm 10 and cancellation diaphragm 18 need not be the same. Such individual processing/filtering may be performed by using post filters 66, 68 as briefly discussed above in relation to the acceleration and microphone branches of FIG. 6.

The post-filters 66, 68 discussed in relation to FIG. 6 can be implemented in a number of technologies. As mentioned above, these can be mechanical, pneumatic, electrical analog, digital or software implementations. These implementations are well known to those skilled in the art. A particular useful subset of these filters 66, 68 include, but are not limited to: mechanical filters using masses, spring constants, and dampers; acoustic filters using tubing of appropriate lengths and diameters; electrical filters designed as, especially, second order physical system analogs, such as biquad or Sallen-Key implementations; digital or software implementations using lattice filters, finite impulse response, infinite impulse response, Fourier transforms, or polyphase subband processors. The digital and software implementations may be implemented in ASICs, FPGAs, DSPs, general-purpose processors, or random logic.

It will be appreciated that there may be some advantage into splitting the post-filters 66, 68 into several stages, and implementing, for instance, part of the filter electrically while a second part is implemented in, for example, software. For instance, implementing some of the filtering electrically can reduce the dynamic range requirements of the software implementation by reducing differences between the peaks of the response functions and the valleys. Stated otherwise, this allows 'pre-whitening' the transfer function. This can be desirably carried over to pre-whitening the actual input signal spectrum, so that the output of the first stage of a multiple stage post-filter has reduced differences between the peaks of the output spectrum and the valleys.

Optimum settings for the filter parameters may be determined by a number of approaches. These include, but are not limited to, minimization of the following error norms:

L-k-norm, where k is 1 through infinity. This subsumes the absolute value of the error (L-1-norm), the RMS value (L-2-norm), and the maximum value (L-infinity-norm).

Weighted averages of any of the above error norms, where the weighting is performed over frequency.

A metric of the degree of oscillation of the system, for instance, House Ear Institutes "PCR" metric, which measures the ratio of power concentrated in the strongest 5 spectral lines vs. the total power.

The number of free parameters of the post-filters 66, 68 determines largely how complete the cancellation can be. For example, in the case relating to equation 4 above, in which Gm=k*allpass, Ga=−k Hmv/Hav, the value of Hmv/Hav may be approximated by using a single fixed number, $\alpha$. This single fixed value may be chosen to be the optimum gain that minimizes one of the error norms above. By way of further example, where the error norm selected is the RMS error, it will be appreciated that unless Hmv and Hav are identical except for magnitude, a single gain adjustment cannot cause complete cancellation. Therefore, it may be preferable to choose to approximate the value of Hmv/Hav in the usual way, that is, using the ratio of two polynomials (also called a rational polynomial). This may be done in either the s- or the z-domain. When this is done, the numerator polynomial is chosen to have a degree of n while the denominator is chosen have a degree of m. Having n=2 and m=2 gives a good approximation to the response of a well-damped microphone and accelerometer. Such a rational polynomial has 6 free parameters. Other values (degrees) of n and m may be used. When the error is compared with the number of degrees, the majority of the error can be removed using just the n=2, m=2 rational polynomical, but typically more and more error can be removed with higher and higher values of n or m.

It will be appreciated that reducing the degree of the rational polynomial reduces the complexity of the post-filter, and either the number of components required or the amount of time and memory space needed. Thus, obtaining a good fit with a minimum degree polynomial is important to minimize size and/or power requirements.

When operating the microphone diaphragm 10 and accelerometer 60 above their resonant frequency, they are relatively insensitive to changes in such variables as skin thickness and density. As mentioned elsewhere in this disclosure, operating in this regime can reduce acoustic sensitivity, and it may simply be difficult to achieve the needed mechanical resonances at a low enough value to cover the frequency range of interest.

To achieve better cancellation between the microphone and accelerometer acceleration responses, the coefficients for the post filters 66, 68 can be adjusted for best cancellation. This is more easily accommodated in an (at least partial) electrical or software implementation than in a purely mechanical or pneumatic approach.

Figure 12:
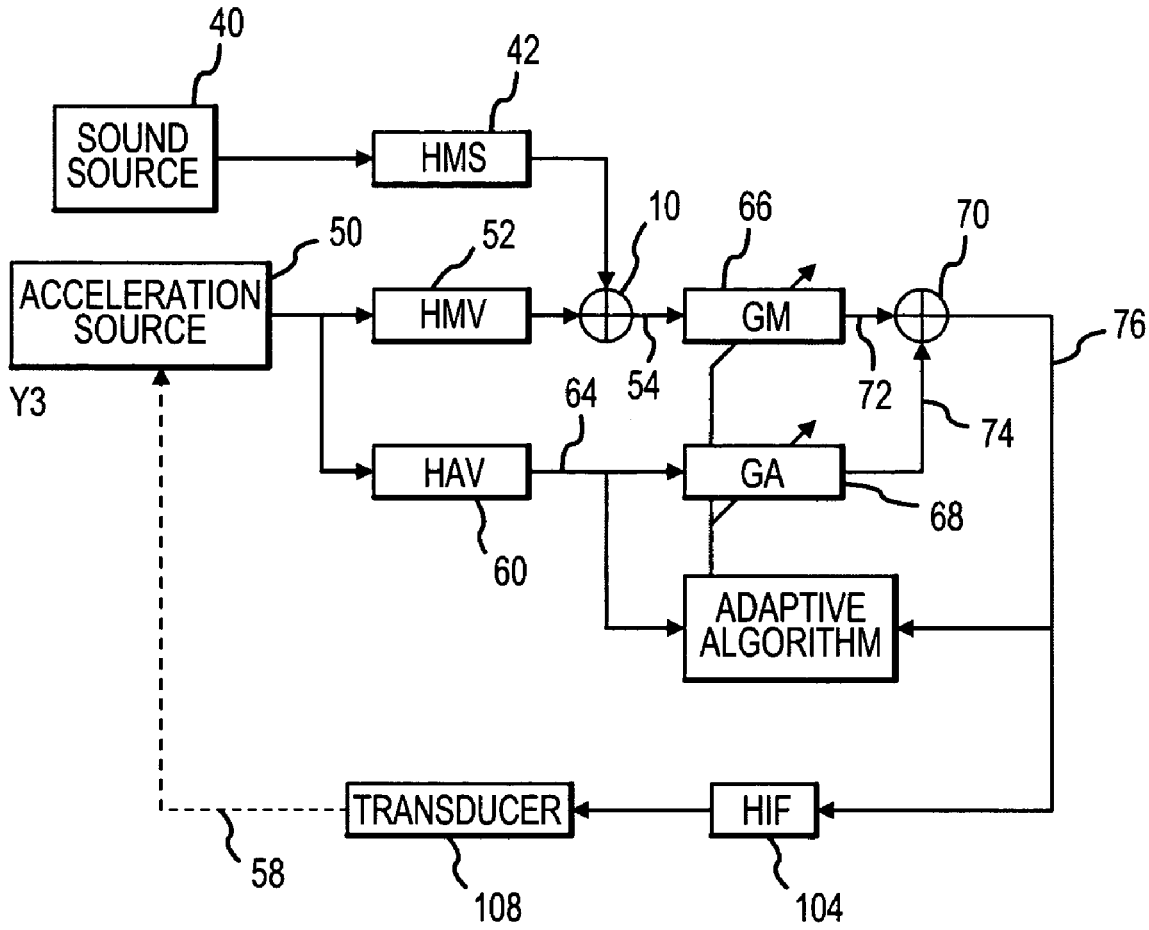
FIG. 12 illustrates a signal flow block diagram of a further embodiment of an implantable hearing instrument.

In order to accommodate changes to the microphone acceleration response due to changes in, for instance, skin thickness and density, due to posture, diurnal variations, etc., it is useful to have an adaptive implementation, such as that illustrated in block diagram FIG. 12. In this manner, the output 76 of the second summer 70 is compared with the output 64 of the accelerometer 60 using an adaptive algorithm 78. The filter parameters of one or both post filters 66, 68 may be adjusted by the adaptive algorithm 78 to eliminate any accelerometer component from the output 76. Those skilled in the art will appreciate that there are many variations that may be incorporated with the use of an adaptive filter(s), see, for instance "Introduction to Adaptive Filters," by Simon Haykin $2^{nd}$ edition, 1992, Macmillan Press. One embodiment is that of an adaptive algorithm using any one of a number of variations on the LMS (least mean squares) algorithm, since in practice this is found to be relatively robust and requires relatively modest resources.

Those skilled in the art will appreciate variations of the above-described embodiments that fall within the scope of the invention. For instance, it may be advantageous to fill the space between opposing diaphragms with a high density flexible material (i.e., a lossy energy dissipating material) to improve sensitivity and/or reduce the resonant frequency of the diaphragm(s). In one embodiment, a titanium powder may be added to a silicone elastomer or gel to prove a material that may be formed into a material having an extremely low resonant frequency. As a result, the invention is not limited to the specific examples and illustrations discussed above, but only by the following claims and their equivalents.

The invention claimed is:

1. An implantable microphone, comprising:

a housing having an internal chamber with an aperture thereto;

a first diaphragm sealably positioned across said aperture, wherein said first diaphragm is operative to move in response to an acoustic force and an acceleration force present in a media overlying said first diaphragm;

a cancellation surface interconnected to said housing, wherein at least a portion of said cancellation surface moves relative to said housing in response to said acceleration force acting on said housing; and a sensor for generating a first output signal indicative of relative movement between said first diaphragm and said cancellation surface.

2. The microphone of claim 1, wherein said output signal corresponds to said acoustic forces.

3. The microphone of claim 1, wherein said first diaphragm and said cancellation surface each have a resonant frequency of less than about 2000 Hz.

4. The microphone of claim 3, wherein said first diaphragm and said cancellation surface each have a resonant frequency of less than about 200 Hz.

5. The microphone of claim 3, wherein said first diaphragm and said cancellation surface have substantially equal resonant frequencies.

6. The microphone of claim 1, wherein said sensor is further operative to measure at least one of:

a pressure associated with an enclosed space between said first diaphragm and said cancellation surface;

a physical change between pre-selected regions on said first diaphragm and said cancellation surface;

a electrical change between pre-selected regions on said first diaphragm and said cancellation surface; and a force change between pre-selected regions on said first diaphragm and said cancellation surface.

7. The microphone of claim 6, wherein said physical change comprises at least one of:

a distance between pre-selected regions on said first diaphragm and said cancellation surface;

a velocity between pre-selected regions on said first diaphragm and said cancellation surface.

8. The microphone of claim 6, wherein said electrical change between pre-selected regions on said first diaphragm and said cancellation surface comprises at least one of;

a voltage;

a current;

a capacitance; and an inductance.

9. The microphone of claim 8, further comprising:

a first electrode associated with said first diaphragm; and a second electrode associated with said cancellation surface.

10. The microphone of claim 1, wherein said cancellation surface comprises a compliantly supported proof mass.

11. The microphone of claim 10, wherein said sensor comprises a piezo-active material having a first portion in contact with said first diaphragm and a second portion in contact with said proof mass.

12. The microphone of claim 11, wherein said piezo-active material compliantly supports said proof mass.

13. The microphone of claim 1, wherein said first diaphragm and said cancellation surface define a trapped volume, and wherein said first diaphragm and said cancellation surface are operative to move relative to at least a portion of said trapped volume.

14. The microphone of claim 13, wherein said sensor comprises a microphone element operative to sense a change in pressure in said trapped volume.

15. The microphone of claim 13, wherein said trapped volume is at least partially filled with an acoustic media.

16. The microphone of claim 15, wherein said acoustic media comprises at least one of:

a gas;

a liquid;

an elastomer; and a gel.

17. The microphone of claim 1, wherein said cancellation surface comprises a second diaphragm.

18. The microphone of claim 17, wherein said second diaphragm is disposed within said housing and in a spaced relationship with said first diaphragm.

19. The microphone of claim 17, wherein said first and second diaphragms are like shaped.

20. The microphone of claim 17, wherein the peripheries of said first and second diaphragms are rigidly interconnected.

21. The microphone of claim 17, wherein said second diaphragm comprises a mass loaded diaphragm.

22. The microphone of claim 21, wherein a mass loading of said second diaphragm is substantially equal to a mass loading of said first diaphragm by said overlying media.

23. The microphone of claim 1, wherein said first diaphragm further comprises:

a reinforcing plate attached to a surface of said first diaphragm.

24. The microphone of claim 1, wherein:

said first diaphragm is operative to generate a microphone output signal corresponding to movement of said first diaphragm; and said cancellation surface is operative to generate a cancellation output signal corresponding to movement of said cancellation surface.

25. The microphone of claim 24, wherein said sensor is operative to receive and combine said microphone output signal and said cancellation output signal to generate said first output signal.

26. The microphone of claim 25, wherein said sensor subtracts said cancellation output signal form said microphone output signal to generate said first output signal.

27. The microphone of claim 25, further comprising at least one of:

a microphone filter for filtering said microphone output signal; and a cancellation surface filter for filtering said cancellation output signal.

28. An implantable microphone, comprising:

a housing having an internal chamber with an aperture thereto;

a first diaphragm sealably positioned across said aperture;

a second diaphragm at least partially disposed within said housing and in a spaced relation to said first diaphragm, wherein said first and second diaphragms define a trapped volume;

a proof mass attached to said second diaphragm; and a sensor operative to sense pressure changes of said trapped volume and generate an output signal indicative thereof.

29. The microphone of claim 28, wherein:

said first diaphragm is adapted to move in response to acoustic forces and acceleration forces present in a media overlying said first diaphragm; and said proof mass is adapted to move said second diaphragm in response to acceleration forces acting on said housing.

30. The microphone of claim 28, wherein said second diaphragm is disposed in a substantially parallel relationship with said first diaphragm.

31. The microphone of claim 28, wherein said first and second diaphragms have substantially similar shapes.

32. The microphone of claim 28, wherein peripheral portions of said first and second diaphragms are rigidly interconnected.

33. The microphone of claim 28, wherein said trapped volume is at least partially filled with an acoustic media.

34. The microphone of claim 33, wherein said acoustic media comprises at least one of:

a gas;

a liquid;

an elastomer; and a gel.

35. The microphone of claim 28, wherein said trapped volume is at least partially filled with an electrically active material.

36. The microphone of claim 35, wherein said electrically active material comprises at least one of:

a piezo-electric material; and a compressible electret material.

37. An implantable microphone, comprising:

a housing having an internal chamber with an aperture thereto;

a first diaphragm sealably positioned across said aperture, said first diaphragm being operative to receive pressure variations in overlying media and generate a corresponding first output signal;

a cancellation surface interconnected to said housing, said cancellation surface being operative to generate a second output signal indicative of an acceleration acting on said housing; and a device for using at least a portion of each of said first output signal and said second output signal to generate a combined output signal, said combined output signal being operative to actuate an actuator of a hearing instrument.

38. The microphone of claim 37, wherein said first output signal further comprises:

an acoustic component corresponding with an acoustic signal and an acceleration component corresponding with an acceleration present within said overlying media.

39. The microphone of claim 38, wherein said device removes said second output signal from said first output signal, wherein an acceleration component of said combined output signal is less than said acceleration component of said first output signal.

40. The microphone of claim 37, wherein said device comprises an electric summation device for combining electric signals and wherein said first and second output signals are electric signals.

41. The microphone of claim 37, further comprising:

a microphone filter for filtering said first output signal; and a cancellation surface filter for filtering said second output signal.

42. The microphone of claim 41, wherein each said filter is operative to adjust at least one of:

a magnitude of a received signal; and a phase of a received signal.

43. The microphone of claim 37, wherein said cancellation surface comprises an accelerometer.

44. The microphone of claim 37, wherein said cancellation surface comprises a second diaphragm.

45. The microphone of claim 44, wherein said second diaphragm further comprises:

a proof mass attached to a surface of said second diaphragm.

46. A method for use in an implantable microphone, comprising the steps of:

providing a first output corresponding to a transcutaneously received pressure signal, said first output having an acoustic component and an acceleration component;

supplying a second output corresponding to an acceleration force acting on said implantable microphone;

using at least a portion of each of said first and second outputs to generate a combined output, wherein an acceleration component of said combined output is less than said acceleration component of said first output.

47. The method of claim 46, further comprising:

generating a stimulation signal using said combined output, said stimulation signal being operative for actuating an actuator of an implantable hearing instrument.

48. The method of claim 46, wherein using said first and second outputs comprises acoustically combining said first and second output to generate said combined output.

49. The method of claim 46, wherein using said first and second outputs comprises electronically combining said first and second outputs to generate said combined output.

50. The method of claim 49, wherein said combining step further comprises:

inverting said second output, wherein said second output is subtracted from said first output.

51. The method of claim 46, further comprising:

filtering at least one of said first and second outputs.

52. The method of claim 51, wherein said filtering step is performed prior to using said first and second outputs to generate said combined output.

53. A method for use in an implantable microphone, comprising the steps of:

locating a diaphragm to receive ambient acoustic signals;

positioning a cancellation surface to be isolated from ambient acoustic signals, wherein at least a portion of said cancellation surface is operable to respond to acceleration forces;

providing a first output from said first diaphragm in response to an applied acceleration, wherein said first output includes a first acceleration component and an acoustic component; and supplying a second output from said cancellation surface in response to said applied acceleration, wherein said second output includes a second acceleration component.

54. The method of claim 53, further comprising:

using at least a portion of said first and second outputs to generate a third output.

55. The method of claim 54, wherein a third acceleration component of said third output is less than said first acceleration component of said first output.

56. The method of claim 54, wherein said using step comprises subtracting said second output from said first output.

57. The method of claim 54, wherein said using step comprises pneumatically combining said first and second outputs.

58. The method of claim 54, wherein said using step comprises electrically combining said first and second outputs.

59. The method of claim 58, further comprising:

filtering at least one of said first and second outputs prior to said using step.

60. The method of claim 54, further comprising:

using said third output to generate a stimulation signal for actuating an actuator of an implantable hearing instrument.

61. The method of claim 53, wherein said positioning of said cancellation surface step comprises disposing said cancellation surface within a housing of an implantable microphone.

62. The method of claim 61, wherein said positioning said cancellation surface step comprises disposing an accelerometer within said housing.

63. The method of claim 53, wherein said supplying a second output step comprises deflecting a second diaphragm in response to said applied acceleration.

64. The method of claim 53, wherein said positioning a cancellation surface comprises co-locating the cancellation surface with the diaphragm.

65. The method of claim 53, wherein said positioning a cancellation surface comprises affixing the cancellation surface to the diaphragm.

* * * * *

UNITED STATES PATENT AND TRADEMARK OFFICE

CERTIFICATE OF CORRECTION

PATENT NO. : 7,214,179 B2
APPLICATION NO. : 11/097113
DATED : May 8, 2007
INVENTOR(S) : Miller et al.

It is certified that error appears in the above-identified patent and that said Letters Patent is hereby corrected as shown below:

Column 24
Line 2, delete “form” and insert therefore --from--.

Signed and Sealed this

Sixteenth Day of October, 2007

JON W. DUDAS
*Director of the United States Patent and Trademark Office*